United States Patent [19]

Beilfuss et al.

[11] Patent Number: 4,695,246

[45] Date of Patent: Sep. 22, 1987

[54] IGNITION CONTROL SYSTEM FOR A GAS APPLIANCE

[75] Inventors: Robert C. Beilfuss, Coppell; David M. Lanier, Richardson; Stanley E. Bammel, Duncanville; Terry J. Huang, Garland; David M. Banks, Richardson, all of Tex.

[73] Assignee: Lennox Industries, Inc., Carrollton, Tex.

[21] Appl. No.: 645,667

[22] Filed: Aug. 30, 1984

[51] Int. Cl.[4] ..... F27N 5/00

[52] U.S. Cl. ..... 431/31; 431/1; 431/69; 126/116 A

[58] Field of Search ..... 431/1, 31, 20, 29, 30, 431/69, 77, 78; 126/116 A

[56] References Cited

U.S. PATENT DOCUMENTS

| | | | |
|---|---|---|---|
| 3,872,320 | 3/1975 | Juskewicz, Jr. . | |
| 3,999,933 | 12/1976 | Murphy . | |
| 4,000,961 | 1/1977 | Mandock . | |
| 4,038,019 | 7/1977 | Matthews . | |
| 4,116,613 | 9/1978 | Matthews . | |
| 4,145,179 | 3/1979 | Tanaka et al. . | |
| 4,192,641 | 3/1980 | Nakagawa et al. | 431/71 X |
| 4,235,587 | 11/1980 | Miles . | |
| 4,260,362 | 4/1981 | Matthews . | |
| 4,298,335 | 11/1981 | Riordan et al. . | |
| 4,303,385 | 12/1981 | Rudich, Jr. et al. . | |
| 4,319,873 | 3/1982 | Michaud et al. . | |
| 4,381,075 | 4/1983 | Cargill et al. . | |
| 4,389,184 | ,6/1983 | Tanaka et al. . | |
| 4,415,328 | 11/1983 | Grunden et al. | 431/31 X |
| 4,496,305 | 1/1985 | Bentz | 431/31 X |

*Primary Examiner*—Randall L. Green

*Attorney, Agent, or Firm*—Allegretti, Newitt, Witcoff & McAndrews, Ltd.

[57] ABSTRACT

An ignition control system for a direct ignition gas appliance, such as a furnace. A main gas valve, spark generator, flame sensor, and purge blower are all interconnected to a single controller. The controller issues a purge signal to the blower for a first predetermined period. Thereafter, for a second predetermined period, the controller issues an interconnect signal to allow the main gas valve to open and an ignition signal to cause the ignition source to ignite the gas flowing into the appliance from the valve. If the controller thereafter fails to receive a signal from the flame sensor, the attempt at ignition was unsuccessful. After a predetermined number of unsuccessful attempts at ignition, the controller issues a lockout signal to the valve. Moreover, the controller includes redundant circuits for detecting malfunctions within itself and responsively closing the main gas valve.

14 Claims, 6 Drawing Figures

THERMOSTAT
20
GAS VALVE ASSEMBLY
14
PURGE BLOWER
16
IGNITION SOURCE
18
48
26
28
30
32
34
36
38
40
42
24
ERROR DETECTOR
56
MICROPROCESSOR CIRCUIT
54
VOLTAGE CONTROLLER
58
62
60
64
44
19
46
FLAME SENSING CIRCUIT
23
22
FLAME SENSOR POWER SOURCE
66
27
50
48
POWER SOURCE
12
FURNACE
10
17
8

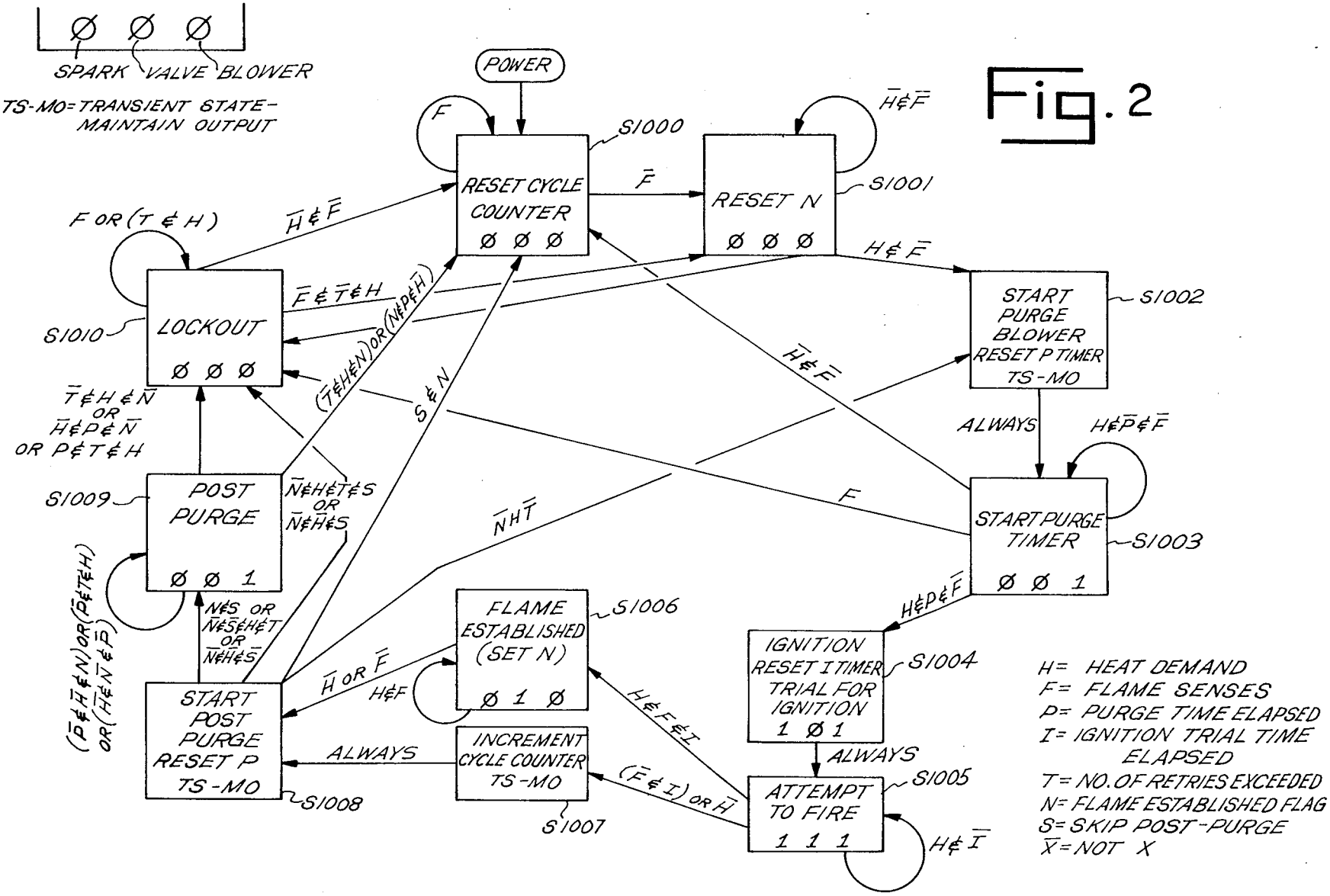
Fig. 2
POWER
RESET CYCLE COUNTER
S1000
RESET N
S1001
START PURGE BLOWER RESET P TIMER TS-MO
S1002
START PURGE TIMER
S1003
IGNITION RESET I TIMER TRIAL FOR IGNITION
S1004
ATTEMPT TO FIRE
S1005
FLAME ESTABLISHED (SET N)
S1006
INCREMENT CYCLE COUNTER TS-MO
S1007
START POST PURGE RESET P TS-MO
S1008
POST PURGE
S1009
LOCKOUT
S1010
ALWAYS
H= HEAT DEMAND
F= FLAME SENSES
P= PURGE TIME ELAPSED
I= IGNITION TRIAL TIME ELAPSED
T= NO. OF RETRIES EXCEEDED
N= FLAME ESTABLISHED FLAG
S= SKIP POST-PURGE
X̄= NOT X
SPARK
VALVE
BLOWER
TS-MO= TRANSIENT STATE-MAINTAIN OUTPUT

IGNITION CONTROL SYSTEM FOR A GAS APPLIANCE

BACKGROUND OF THE INVENTION

The present invention relates generally to control systems and more specifically to an ignition control system for a gas appliance, such as a furnace having a direct spark ignition system.

In the typical direct spark ignition system, a main gas valve is opened and an ignition assembly ignites the gas flowing out of the main gas valve into a combustion chamber. The gas is ignited directly by an electronic source of heat, such as a spark generator or a high-temperature resistor, rather than a pilot flame, which provides heat for predetermined time intervals.

A flame probe typically detects whether the ignition assembly has succeeded in igniting the gas. If the ignition assembly has not been successful, or if a flame already established goes out, the main gas valve is closed. In many systems, the valve may not then be reopened until a predetermined period of time has elapsed. This period of time allows a blower to purge any residual gas in the combustion chamber before the valve is reopened and a spark occurs within the chamber. Otherwise, a large amount of gas may have collected within the chamber, and introducing a spark in the chamber before the gas is removed may result in a harmful explosion.

Clearly, the timing of the valve, ignition assembly, and blower is an important feature of safely operating a gas appliance such as a direct ignition furnace. The control for such timing must be very reliable. Generally, the gas valve must be closed when the system malfunctions because of an unknown cause. Otherwise, the gas may continue to flow into the combustion chamber and surrounding areas, even though no flame exists. Thus, gas could fill the chamber (or entire dwelling associated with the appliance) and, upon reaching a critical level, explode.

Thus, if a malfunction occurs within the appliance or within the control itself, the control should revert to failsafe status where the valve is shut. Moreover, if a serious fault occurs, the control should keep the valve closed, or in a "lockout" condition.

Nonetheless, the control must not unnecessarily shut off the valve or go to a "lockout condition." Such unnecessary closing of a valve is, of course, inconvenient to those using the appliance. The control should especially avoid an unnecessary valve closing where the valve is used in a furnace in a cold climate. An unnecessary valve closure could prevent the furnace from heating the associated building. In cold weather, such a shutdown of the furnace could result in broken pipes in the associated building (when the water within the pipes freezes and expands) or even loss of life.

Aside from closing the gas valve when required to lessen the risk of explosion, but not more often than necessary, the control for the appliance should be as inexpensive and easy to use as possible. In this way, the cost of gas appliances may be reduced for consumers, and users of the control will be less likely to operate it incorrectly.

Moreover, the control should have as few discrete components as possible. In this way, the risk that the control has been assembled incorrectly or will malfunction during operation may be reduced.

SUMMARY OF THE INVENTION

In a principal aspect, the present invention is an ignition control system for a gas appliance. The appliance includes a combustion chamber which may receive gas from a source and maintain a flame therein. The control system includes a valve, ignition source, flame probe, blower, and controller.

The valve may receive an interconnect signal and responsively interconnect the source of gas with the appliance. In addition, the valve may receive a lockout signal and responsively disconnect the appliance from the source of gas.

The ignition source may receive an ignite signal and responsively attempt to ignite the contents of the combustion chamber. If a proper mixture of air (oxygen) and gas is within the chamber of a properly functioning furnace, the spark will ignite the air-gas mixture.

The flame sensor probes detects whether a flame exists within the combustion chamber. If a flame does exist, the sensor emits a flame signal. Otherwise, the sensor emits a blank signal.

The blower of the control system may receive a purge signal. Upon receiving the signal, the blower blows gas (and, of course, air) out of the combustion chamber. Operation of the blower thus prevents a dangerously high level of gas from accumulating in the combustion chamber.

Finally, the controller interconnects the valve, flame probe and blower. Upon receiving a demand signal, indicating the appliance should operate, the control issues a purge signal for a first predetermined period. Thus, the blower operates and removes residual gas from the combustion chamber for the first predetermined period. Thereafter, the control issues an interconnect signal to the valve during a second predetermined period. During the second predetermined period, the control also issues an ignite signal to the ignition source, in order to ignite the gas flowing through the valve into the combustion chamber.

In addition, the controller further includes a pulse generator and counter. The pulse generator emits a pulse each time the control receives a blank signal from the flame probe after the second predetermined period. The counter receives and counts each pulse and, after the counter has received a predetermined number of pulses (indicating a predetermined number of unsuccessful attempts at ignition) the counter issues a lockout signal to the valve.

Thus, an object of the present invention is an improved ignition control system for a gas appliance. Another object is a control system that more reliably detects faults and issues a lockout signal to close the gas valve and prevent gas from reaching the appliance. Still another object is a control system that is less likely to shut off the gas valve unnecessarily.

A further object of the present invention is a control system that is less expensive to manufacturer and easier to use. Yet another object is a control system that uses a fewer number of discrete components and thus is less likely to malfunction.

These and other objects, features, and advantages of the present invention are discussed or apparent in the following detailed description.

BRIEF DESCRIPTION OF THE DRAWING

A preferred embodiment of the present invention is described herein with reference to the drawing wherein:

FIG. 2 is a state diagram showing how the invention of FIG. 1 responds to input signals;

DETAILED DESCRIPTION OF A PREFERRED EMBODIMENT

Figure 1:
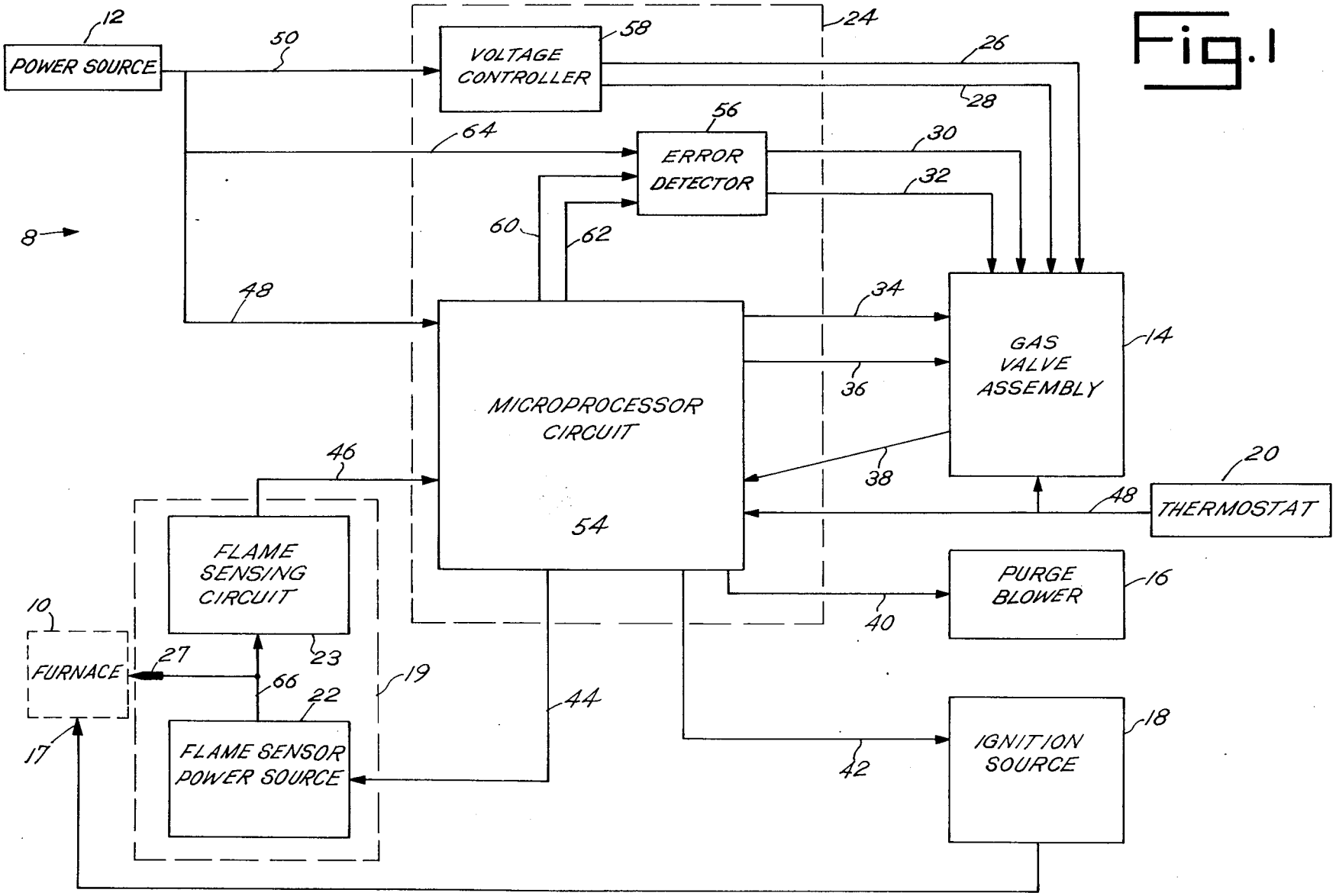
FIG. 1 is a block diagram of the present invention.

Referring to FIGS. 1–4, a preferred embodiment of the present invention is shown as an improved ignition control system, generally designated 8, for a gas appliance, such as a pulse combustion furnace 10. As shown in FIG. 1, the control system 8 includes a power source 12, gas valve assembly 14, purge blower 16, ignition source 18, flame sensor 19, and thermostat 20, which physically affect the operation of the furnace 10. The gas valve assembly 14 includes a mechanical gas valve (not shown) and the ignition source 18 includes an ignitor 17 interconnected to the furnace 10. The flame sensor 19 includes a flame probe 21, power source 22 and flame sensor circuit 23.

In addition, the control system 8 includes a controller 24 which is in communication with each of the other elements via signal lines 26, 28, 30, 32, 34, 36, 38, 40, 42, 44, 46, 48, 50. The overall operation of the controller 24 and its effect upon the other elements of the control system 8 are discussed below.

When the thermostat 20 senses that the air temperature surrounding it has dropped below a predetermined level, the thermostat 20 sends a demand signal, along the line 48, to the controller 24. The controller 24 may then responsively operate the purge blower 16 (by sending a purge signal to the purge blower 16 along the line 40) in order to purge residual gas from the combustion chamber (not shown) of the furnace 10.

The controller 24 may also responsively open the mechanical gas valve (by sending an interconnect or enable signal to the gas valve assembly 14 along the line 34) to allow gas to flow into the combustion chamber. (The controller 24 also discontinues any disable signal that may be transmitted to the gas valve assembly 14 via the line 36.)

Finally, the controller 24 may also activate the ignition source 18 (by sending an ignition signal to the ignition source 18 along the line 42). Accordingly, the gas flowing into the combustion chamber from the gas valve assembly 14 may be ignited with the ignitor.

The controller 24 also receives a flame signal from the flame sensor 19, via the line 46, when a flame is detected in the combustion chamber. Otherwise, the flame sensor 19 issues a blank signal to the controller 24.

The controller 24 may also react to a combination of signals which indicate that a malfunction has occurred. For example, the flame sensor 19 may issue a blank signal, indicating that no flame is sensed, even though the controller 24 is issuing an interconnect signal to open the gas valve assembly 14 and ignition signals to ignite the gas in the combustion chamber. Under such conditions, the controller 24 issues a disable or "lock-out" signal to the gas valve assembly 14, via the line 36, and issues a blank signal to the gas enable line 34. Thus, the gas valve assembly 14 is closed, reducing the risk that gas will explode in an uncontrolled manner.

The controller 24 includes a microprocessor circuit 54, error detector 56, voltage controller 58, redundant error check lines 60, 62, and reference line 64. The error detector 56 of the controller 24 senses if the microprocessor circuit 54 is malfunctioning.

In operation, the microprocessor circuit 54 receives a 60 hertz signal from the power source 12 via the line 48. If the microprocessor circuit 54 is functioning properly, it issues a 60 hertz signal along both of the redundant error check lines 60, 62. The error detector 56 receives the signals from the redundant error check lines 60, 62. In addition, the error detector receives a 60 hertz signal, via the reference line 64, from the power source 12.

If all three signals from the redundant error check lines 60, 62 and reference line 64 are not substantially equivalent (having the same 60 hertz frequency with only slight phase shift) the microprocessor circuit 54 may be malfunctioning. Accordingly, the error detector 56 then issues redundant disable signals, via the lines 30 and 32, to close the gas valve assembly 14.

The voltage controller 58 receives a 24 v.a.c. input signal, via the line 50, from the power source 12. The voltage controller 58 provides a substantially constant −9 v.d.c. source of power for the rest of the controller 24, as well as the gas valve assembly 14, ignition source 18, and flame sensor 19.

The voltage controller 58 also detects when the −9 v.d.c. source of power exceeds the safe operating limits for other electrical components in the control system 8, such that the components may be damaged and thereafter malfunction. Upon sensing too large an input signal, the voltage controller 58 issues a disable signal, via the lines 26 and 28, to the gas valve assembly 14 in order to close it. Again, two lines 26, 28, rather than only one line, are used to transmit the disable signal, thus increasing the reliability and safety of the control system 8.

The control system 8 includes still further safety features to help ensure that the gas valve assembly 14 is closed if the control system 8 itself should malfunction. For example, the microprocessor circuit 54 periodically (five times per second) transmits a rapid, predetermined sequence of enable and disable signals along the lines 34, 36. If the gas valve assembly 14 is functioning properly, a predetermined signal should be sent to the microprocessor circuit 54 via the line 38.

If the predetermined signal does not occur on line 38, the gas valve assembly 14 may be malfunctioning. Accordingly, the microprocessor circuit 54 sends an extended disable signal to the gas valve assembly 14 along the line 36 and turns off the enable signal that may be transmitted to the gas valve assembly via the line 34.

The microprocessor circuit 54 also checks the function of the flame sensor 19 five times per second. The flame sensor 19 includes the power source 22, flame sensing circuit 23, coupling line 66, and flame probe 21.

The flame sensor power source 22 sends a high voltage, 5000 hertz signal along the coupling line 66 to the flame sensing circuit 23. The flame probe 21 is interconnected to the coupling line 66, and, if a flame occurs in the furnace 10, draws a slight amount of direct current from the coupling line 66 due to the flame rectification phenomenom.

The flame sensing circuit 23 determines whether the probe 21 and flame have shunted any d.c. current from the coupling line 66 and, thus, whether a flame exists. Notably, the flame sensing circuit 23 is substantially unaffected by change in a.c. current.

If a flame does exist, a positive "flame" signal is transmitted to the microprocessor circuit 54 via the line 46. Otherwise, the flame sensing circuit 23 tranmits a "null" or blank signal to the microprocessor circuit 54.

Periodically, when the microprocessor circuit 54 is receiving a flame signal, it issues a disable signal, via the line 44, to the flame sensor power source 22. If the flame sensing circuit 23 is then functioning properly, it will necessarily stop detecting a flame (even if one exists). Thus, the functioning flame sensing circuit 23 will issue a blank signal to the microprocessor circuit 54.

If the microprocessor circuit 54 does not receive a blank signal from the flame sensing circuit 23 upon issuing a disable signal along the line 44, the flame sensing circuit 23 may be falsely indicating the existence of a flame. Thus, for such a condition, the microprocessor circuit 54 will issue a disable signal to the main gas valve assembly 14 via the line 36 and discontinue sending an enable signal to the main gas valve assembly 14 via the line 34.

The logic by which the controller 24 determines which signals to issue to the ignition source 18, gas valve assembly 14, and purge blower 16 are shown in the state diagram of FIG. 2. Each of the eleven possible states for the controller 24 are shown in FIG. 2. The state diagram of FIG. 2 is unambiguous. Thus, for each set of inputs from the power source 12, thermostat 20, flame sensor 19, and internal components of the control system 8, the signals issued by the controller 24 to the ignition source 18, gas valve assembly 14, and purge blower 16 are shown.

The inputs to the controller 24 are represented in the state diagram by arrows pointing to each of the state blocks S1000–S1010, which represent the eleven possible states of the controller 24. Each arrow points to the state to which the controller 24 moves after sensing a particular signal. The wording above each arrow represents what particular signal has been sensed. For convenience, the signals are abbreviated according to the following tables.

EXTERNAL SIGNALS TO THE CONTROLLER 24

H: Heat Demand signal issued by the thermostat 20.
F: Flame signal issued by the flame sensor 19.
PWR: Power signal provided by the power source 12.

INTERNAL SIGNALS GENERATED BY THE CONTROLLER 24

P: Preset purge time for purge blower 16 to operate has elapsed.
I: Preset trial time for ignition elapsed.
T: Preset number for unsuccessful attempts at ignition has been exceeded.
N: Internal notation, or flag, has been set indicating that an attempt at ignition was successful and that a flame has been established.
S: Internal notation, or flag, that the controller 24 has been preset to "skip post purge"—i.e. not to operate the purge blower 16 after a flame in the combustion chamber is discontinued.

NOTATION

—: Such a "bar" above any of the previously defined letters indicates that the referenced signal is the opposite of the signal that is signified by the same letter, but without a bar. Thus, while "H" indicates a heat demand signal issued by the thermostat 20, "$\overline{H}$" indicates the *lack* of a heat demand signal issued by the thermostat 20.

The output of the controller 24 may be signified by three characters at the bottom of each of the eleven state blocks. The left-most character indicates whether the controller 24 issues an ignition signal to the ignition source 18; the center character indicates whether an interconnect signal is being issued to the main gas valve assembly 14; and the right-most character indicates whether a purge signal is issued to the purge blower 16. The character of a "1" indicates that a signal (ignition, interconnect, or purge) is being issued by the controller 24. The character of a "O" indicates that a signal (ignition, interconnect, or purge) is *not* being issued by the controller 24. Thus, for example, the characters "1 1 0" at the bottom of a state block would indicate that the controller 24 *is* issuing ignition signal to the ignition source 18 and an interconnect signal to the gas valve assembly 14 but *is not* issuing a purge signal to the purge blower 16.

In addition, the characters "TS-MO" at the bottom of a state block indicate that the controller 24 is in a Transient State. Consequently, the controller 24 will Maintain the Output that it had in the immediately preceding state block.

Upon first starting, as shown in FIG. 2, the controller 24 receives a power signal from the power source 12 while in the initial state S1000. No ignition, valve, or purge signals are issued. The controller 24 sets an internal cycle counter (not shown) to a predetermined number, such as five. If the controller 24 does not receive a flame signal from the flame sensor 19 (i.e. it receives a "blank" signal), the controller 24 moves to the state shown in the state block S1001. The flame established flag, N, is then set to zero.

If the flame sensor 19 detects a flame, a malfunction has occurred, since neither ignition or interconnect signals have been issued by the controller 24. Thus, the controller 24 moves to the "lockout" state S1010, where the disable signal is issued to the gas valve assembly 14.

If no flame is sensed, but the thermostat 20 has issued a demand signal to the controller 24, the controller 24 moves to the state S1002. The controller 24 then issues a purge signal to the purge blower 16, so that the purge blower 16 will remove any residual gas from the combustion chamber. The controller 24 also sets an internal purge timer, called P, for a predetermined time interval.

The controller next moves to the state S1003 and initiates the purge timer, P. The controller 24 may stay in the state S1003 until the timer P indicates that the purge blower 16 has operated a predetermined time interval, such as 30 seconds, and then moves to the state S1004.

If, while waiting for the timer P to indicate that the purge blower 16 has operated long enough, the flame sensor 19 indicates the existence of a flame, the controller 24 again moves to the lockout state S1010. If no flame is detected and the thermostat 20 is no longer calling for heat, however, the controller 24 returns to the initial state S1000.

If no flame is detected and the purge blower 16 operates for the predetermined interval, the controller 24 moves to the state S1004, where the controller 24 issues an ignition signal to cause the ignition source 18 to start operating. In addition, an ignition timer, called I, is reset to a predetermined number. The controller 24 then moves to the state S1005, where an interconnect signal is sent to the gas valve assembly 14 so that it will allow gas to flow to the combustion chamber.

The controller 24 stays in the state S1005 for a predetermined period, such as 8 seconds, as measured by the ignition timer, I. If a flame is established and the time period has elapsed, the controller moves to the state S1006, and the flame established flag is then set. The controller 24 then stays in the state S1006 until there is no longer a demand for heat from the thermostat 20 or the flame is discontinued. At that time, the controller 24 moves to the state S1008.

If, while at state S1005, a flame is not established at the end of the time period set by the timer, I, or if the thermostat 20 no longer sends a demand signal to the controller 24, the controller 24 moves to the state S1007. The controller 24 then increments the cycle counter by one and moves to the state S1008.

At the state S1008, the controller 24 checks the N flag and thus determines whether a flame had been established during the last attempt at ignition. If no flame was established and there is still a demand for heat, the controller 24 checks the cycle counter.

The cycle counter keeps track of how many times the control system 8 has attempted ignition but failed. If a large number (such as five) of successive attempts have failed to result in a flame, the control system 8 or furnace 10 may be malfunctioning. Thus, if the count of the cycle counter exceeds the predetermined number, the controller 24 moves to the lockout state S1010. If the controller 24 is preset to skip past purge blower 16 operation, the controller 24 moves directly to the lockout state S1010.

The controller 24 may also be preset, however, such that after every successful and unsuccessful attempt at ignition, the purge blower 16 operates for a predetermined period, such as 30 seconds. If the controller 24 has been so preset, the purge timer P is again reset.

If a flame had been established and the controller 24 has been set to skip past purge blower operation, the controller 24 moves to the initial state S1000. If the thermostat 20 still calls for heat, no flame has been established, and the predetermined number for successive attempts at ignition has not been exceeded, the controller 24 moves to the state S1002.

Otherwise, the controller 24 moves to the state S1009. At state 1009, a purge signal is issued to the purge blower 16 until the timer P indicates that the predetermined time period has elapsed. Thereafter, the controller 24 may either move to the lockout state S1010 (if the count of the cycle counter exceeds the preset number) or to the initial state S1000 (if the cycle counter did not exceed the preset number or if a flame had previously been established).

If the controller 24 has been preset to skip the post-ignition operation, but a flame was established during the last attempt at ignition, the controller avoids states S1009 and S1010. Instead, the controller 24 moves to the initial state S1000 previously discussed. Notably, at the state S1000, the recycle counter is reset. In this way, when another demand for heat is issued and the controller 24 again reaches the state S1008, only successive ignition failures will be counted. Ignition failures which occurred before the most recent successful ignition attempt are ignored.

Once in the lockout state S1010, however, the controller 24 may move out of the lockout state S1010 to the initial state S1000 if the thermostat 20 no longer issues a demand signal and no flame is sensed in the combustion chamber. Such an event may occur, for example, when an owner or operator of the furnace corrects the error that caused the controller 24 to move to the lockout state S1010 and then manually adjusts the thermostat 20 so that it temporarily fails to issue the demand for heat.

Figures 3, 3A:
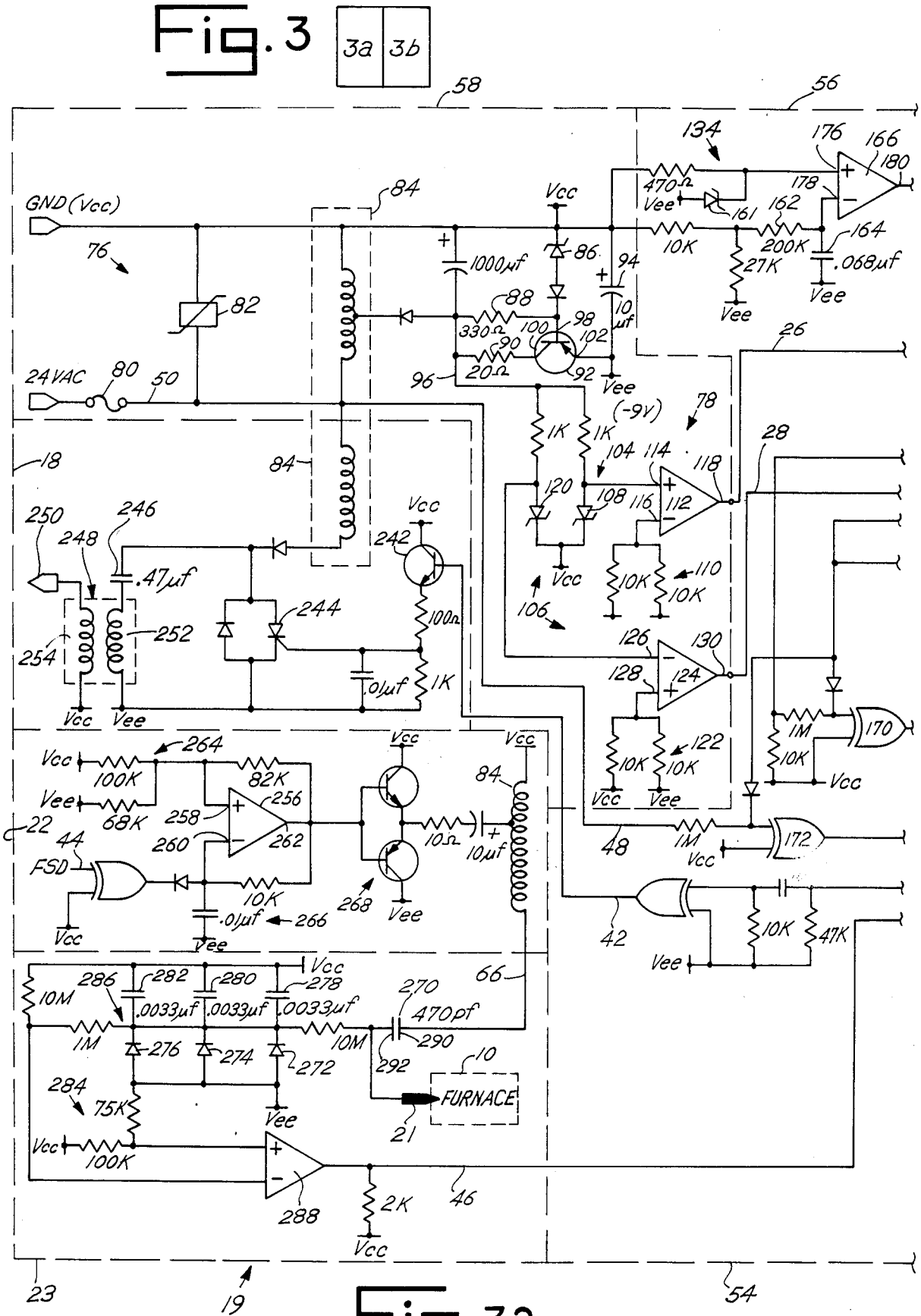
FIG. 3 is a block diagram depicting the relationship of schematic diagrams, FIG. 3*a* and FIG. 3*b;*
FIG. 3*a* is detailed schematic diagram of the left hand block of FIG. 3 incorporating the invention of FIG. 1.
Figure 3B:
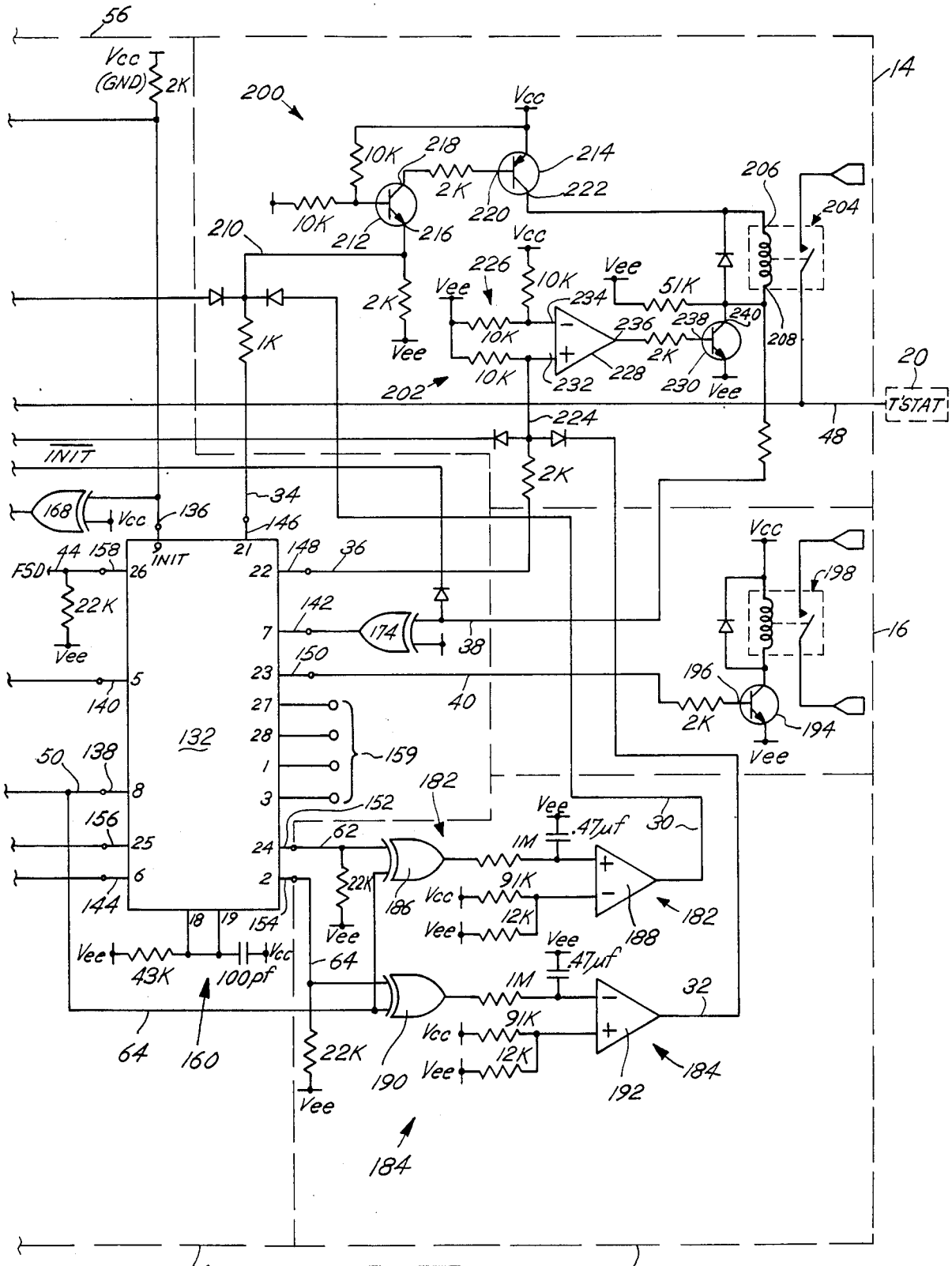
FIG. 3*b* is a detailed schematic diagram of the right hand block of FIG. 3 incorporating the invention of FIG. 1.
Figure 4:
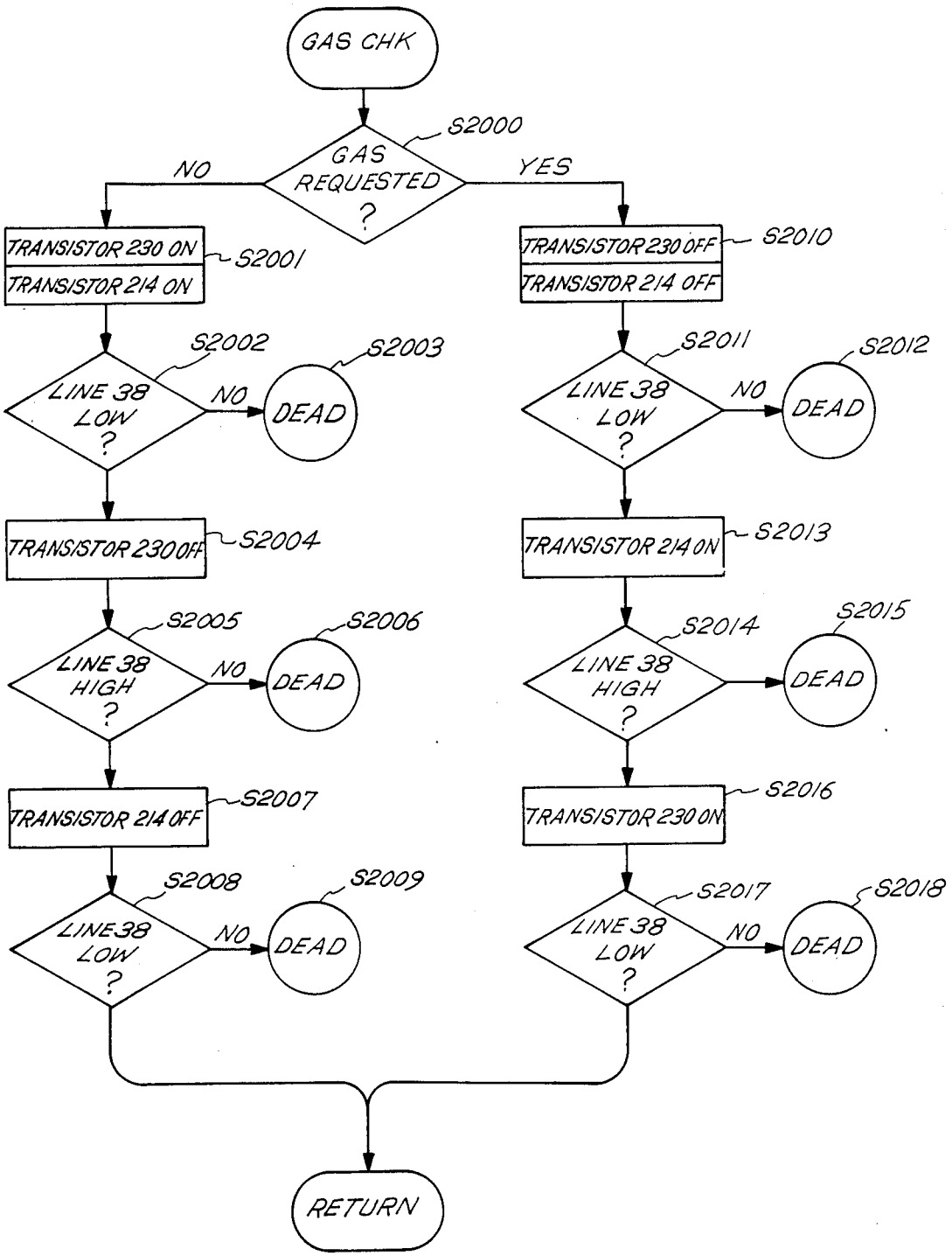
FIG. 4 is a flow chart of a test sequence used by the microprocessor shown in FIG. 3 in order to determine whether the valve supplying gas to the appliance should be closed.

The hardware used to accomplish the commands shown in the state diagram is set out in detail in FIG. 3. The control system 8 includes the voltage controller 58, microprocessor circuit 54, error detector 56, gas valve assembly 14, purge blower 16, ignition source 18, and flame sensor 19 previously discussed. The blocks for such elements, which are shown in FIG. 1, have been somewhat arbitrarily redrawn in FIG. 3. It is important to note that many circuit elements do not necessarily belong in one block or the other or they may belong in several blocks. Nonetheless, the blocks have been drawn in FIG. 3 as an aid to understanding the present invention.

VOLTAGE CONTROLLER 58

The voltage controller 58 is interconnected to the power source 12, from which it receives a 24 volt, 60 hertz signal along the input line 50. The voltage controller 58 includes a voltage source circuit 76 and a protection circuit 78.

The voltage source circuit 76 includes a one amp fuse 80, varistor 82, center-tapped autotransformer, 84, zener diode 86, two resistors 88, 90, current controlling transistor 92, capacitor 94, and an output line 96, interconnected as shown. The transistor 92 includes a base 98, collector 100, and emitter 102.

The fuse 80 protects the control system 8 against damage if it should develop a short circuit, and the varistor 82 protects the control system 8 from damage if large voltage transients occur along the line 50. The autotransformer 84 also dampens the effects of voltage spikes occurring along the line 50.

The zener diode 86, in parallel with the resistor 88, insures that a substantially constant current flows through the resistor 88 and into the base 98 of the transistor 92. Thus, the voltage of the emitter 102 of the transistor 92 (signified by Vee) remains at a substantially constant value of −9 v.d.c.

The resistor 90 is interconnected between the collector 100 of the transistor 92 and the output line 96, thus protecting the transistor 92 by limiting the current that may flow through it. The capacitor 94 reduces the unwanted "AC ripple" in the voltage at the emitter 102 of the transistor 92.

The protection circuit 78 senses the voltage provided at the emitter 102 of the transistor 92 (called Vee). If the voltage is too high, indicating that components of the control system 8 may be harmed and thereafter malfunction, the protection circuit 78 closes the gas valve assembly 14.

The protection circuit 78 includes first and second segments 104, 106. The first segment 104 includes a zener diode 108, voltage dividing resistors 110, and operational amplifier 112, interconnected as shown. The operational amplifier 112 includes first and second inputs, 114, 116 and an output 118.

The zener diode 108 establishes a reference voltage of approximately −5.1 volts at the first input 114 to the operational amplifier 112. The voltage dividing resistors 110 establish a voltage at the second input 116 of the operational amplifier 112 of Vee/2. If the power source 12 supplies a proper voltage, Vee/2 equals approximately 4.5 volts, and the output of the operational amplifier 112 is left in a low state. If the power source 12 provides too large a voltage, Vee is substantially larger than −10.2 volts. As a result, the voltage of the second input 116 is substantially larger than the voltage of the first input 114 (−5.1 volts). The output 118 of the operational amplifier 112 thus reaches a high voltage state and the interconnected line 26 thus presents a disable signal to the gas valve assembly 14.

The second segment 106 includes a zener diode 120, voltage dividing resistors 112, and an operational amplifier 124, which are interconnected in a manner similar to that used to interconnect the components of the first segment 104. As before, the operational amplifier 124 includes first and second input 126, 128, and an output 130.

The voltage dividing resistors 122 provide a voltage of approximately Vee/2 to the second input 128, and the zener diode 120 provides approximately −5.1 volts to the first input 126. Unlike the operational amplifier 112 of the first segment 104, however, the operational amplifier 124 of the second segment 106 issues a low voltage only when Vee/2 is substantially larger than −5.1 volts. The low voltage from the output 130 is transmitted as a disable signal, via the line 28, to the gas valve assembly 14.

Notably, either the first or second segments 104, 106 of the voltage protection circuit 78 are capable of sending a disable signal to the gas valve assembly 17 upon sensing too high of a voltage. Such redundancy in the circuitry helps ensure the reliability of the control system 8. Even if, for example, the first segment 104 malfunctions, the second segment 106 may still function and be capable of closing the gas valve assembly 14 if the need arises.

MICROPROCESSOR CIRCUIT 54

The microprocessor circuit 54 includes a microprocessor 132 and initialization circuit 134. The microprocessor 132 is a model TMS 1000 chip manufactured by Texas Instruments Inc. Other, similar microprocessors which are presently available may, of course, also be used with the present invention, with only relatively minor, obvious modifications.

The decision logic of the microprocessor 132 has previously been discussed in association with FIG. 2. The microprocessor 132 includes an initialization lead 136, four input leads 138, 140, 142, 144, seven output leads 146, 148, 150, 152, 154, 156, 158, and four diagnostic leads 159. The microprocessor 132 also includes an internal oscilator, generally designated 160.

The initialization circuit 134 includes a zener diode 161, resistor 162, capacitor 164, operational amplifier 166, and four exclusive OR gates 168, 170, 172, 174, interconnected to the initialization lead 136 and input leads 138–142 as shown. The operational amplifier 166 includes first and second input leads 176, 178 and an output lead 180. When the control system 8 is first turned on and the voltage along the line 50 is increasing from 0 to 24 v.a.c., the input to the initialization lead 136 should be kept at a high voltage state, and the voltage at the input leads 138–142 should be kept in a low state. Otherwise, the microprocessor 132 may malfunction.

When the signal along the input line 50 has substantially reached the full level of 24 v.a.c., the initialization period has ended. The voltage supplied to the initialization lead 136 should be lowered, and the voltage at each of the input leads 138–142 should assume the value of any other signal being supplied to it.

Upon the application of power to the control system 8, the initialization circuit 134 must supply proper voltages to the initialization 136 and input leads 138–142. Thus, the zener diode 161 quickly establishes a large input at the first input 176 of the operational amplifier 166. The second input 178 remains low at a low voltage state until enough current flows through the resistor 162 to substantially charge the capacitor 164.

The output 180 is directly interconnected to the initialization lead 136. In addition, the output 180 of the operational amplifier 166 is interconnected to the inputs of each of the four exclusive OR gates 168–174. Consequently, the outputs of the exclusive OR gates 168–174 must be low, and the outputs of the OR gates are interconnected to the input leads 138–142 of the microprocessor 132.

After a predetermined period of time, the voltage along the input lead 50 substantially reaches 24 v.a.c., and the capacitor 164 charges sufficiently to provide a positive signal to the second input 178 of the operational amplifier 166. As a result, the output 180 of the operational amplifier 166 goes to a low state, and the input leads 138–142 of the microprocessor 132 may assume any value.

The microprocessor 132 receives a 60 hertz signal from the power source 12, via the input lead 138 and the line 64. If the microprocessor 132 functions properly, a 60 hertz signal will also be provided at the output leads 152, 154.

ERROR DETECTOR 56

The error detector 56 includes first and second comparators 182, 184, which receive, respectively, the signals from the two output leads 152, 154 of the microprocessor 132. The first and second comparators 182, 184 also receive the 60 hertz signal from the power source 12 via the line 64.

The first comparator 182 includes an exclusive OR gate 186 and an operational amplifier 188. The exclusive OR gate 186 compares the 60 hertz signal received from the power source 12 via the line 64 with what should also be a 60 hertz signal coming from the microprocessor 132 via the output lead 152 and the line 48. If a significant discrepancy in the frequency or phase of the two signals continues to exist, the operational amplifier 188 provides a positive disable signal to the gas valve assembly 14 via the line 30.

The second comparator 184, having an exclusive OR gate 190 and an operational amplifier 192, operates similarly to the first comparator 182. However, the second comparator 184 provides a *low* voltage disable signal to the gas valve assembly 14, via the line 32, upon sensing that the microprocessor 132 is not providing an adequate 60 hertz signal.

Again, the control system 8 includes redundant circuits. Either the first or second comparators 182, 184 is capable of closing the gas valve assembly 14 if the microprocessor 132 fails to provide a proper signal. If one of the comparators should fail, the other comparator would still be ready to close the gas valve assembly 14 if the need arose.

PURGE BLOWER 16

The microprocessor 132 issues purge signal to the purge blower 16 via the output lead 150 and line 40. The purge blower 16 includes a transistor 194, having a base 196, a normally-open relay 198 and a mechanical blowing assembly (not shown).

When the purge signal is issued by the microprocessor 132, the signal is received at the base 196 of the transistor 194, and transistor 194 turns on. As a result, current flows to the normally-open relay 198 and it closes. The mechanical blowing assembly of the purge blower 16 is then activated.

When the purge signal stops, the transistor 194 turns off. The normally open relay 198 then resumes its normally-open position, and the mechanical blower assembly stops.

GAS VALVE ASSEMBLY 14

The gas valve assembly 14 includes top and bottom comparators 200, 202, a normally-open relay 204, and a mechanical valve assembly (not shown). The normally-open relay 204 includes a top 206 and bottom 208 and a mechanical valve (not shown).

The top comparator 200 includes a top disable line 210 and first and second transistors 212, 214, interconnected as shown. The first transistor 212 includes an emitter 216, interconnected to the top disable line 210 and a collector 218. The second transistor 214 includes a base 220, interconnected to the collector 218 of the first transistor 212, and a collector 222, interconnected to the top 206 of the normally-open relay 204.

When a disable signal is provided on either lines 26, 30, or 34, the top disable line 210 receives the signal. As a result, the voltage at the emitter 216 of the first transistor 212 goes to a high state, and the first transistor 212 turns off.

Consequently, the voltage at the collector 218 of the first transistor 212 and at the base 220 of the second transistor 214 goes to a high state, and the second transistor 214 turns off. As a result, no current flows toward the top 206 of the normally-open relay 204, and the relay 204 resumes its normally-open position. The mechanical valve assembly then closes.

Closure of the mechanical valve assembly may also be effected if low voltage disable signals are provided along the lines 28, 32, 36. Such signals are received by the bottom comparator 202, having a bottom disable line 224, voltage dividing resistors 226, an operational amplifier 228, and a transistor 230, interconnected as shown.

The operational amplifier 228 includes a first input 232, interconnected to the lines 28, 32, 36 via the bottom disable line 224. The operational amplifier 228 also includes a second input 234 interconnected to the voltage dividing resistors 226, and an output 236. The transistor 230 includes a base 238, interconnected to the output lead 236 of the operational amplifier 228, and a collector 240, interconnected to the bottom 208 of the normally-open relay 204.

Upon receiving a low voltage disable signal at the first input 232, the operational amplifier 228 issues a low voltage at its output 236. The transistor 230 accordingly turns off. As a result, no current can flow through the normally open relay 204, and it opens. The mechanical valve assembly must then close.

Thus, the control system 8, as before, uses redundant circuits for increased reliability and safety. Either the top or bottom comparators 200, 202 are capable of closing the mechanical valve assembly if the other should fail.

IGNITION SOURCE 18

The microprocessor 132 issues a ignition signal at its output lead 156 and the line 42. The signal is received by the ignition source 18, which includes a transistor 242, a silicon controlled rectifier (SCR) 244, the autotransformer 84, a capacitor 246, a transformer 248, and a spark plug (or "ignitor") 250. The transformer 248 includes a primary coil 252, interconnected to the capacitor 246, and a secondary coil 254, interconnected to the spark plug 250. The spark plug 250 includes a gap (not shown).

Upon receiving the spark pulse from the microprocessor 132, the transistor 242 turns on, causing the SCR 244 to fire. A high voltage charge built up in capacitor 246 by autotransformer 84 then discharges through the SCR 244 and primary coil 252 of the transformer 248. A high voltage is then induced on the secondary coil 254, and such voltage is discharged through the gap of the spark plug 250.

FLAME SENSOR 19

The flame sensor 19 includes the flame sensor power source 22 and flame sensing circuit 23. The flame sensor power source 22 includes an operational amplifier 256, having first and second inputs 258, 260, and an output 262, voltage dividing resistors 264, an R-C circuit 266, two transistors 268, and the autotransformer 84. The voltage dividing resistors 264 are interconnected to the first input 258 of the operational amplifier 256, and the R-C circuit 266 is interconnected to both the second input 260 and output 262 of the operational amplifier 256.

Also, the output 262 of the operational amplifier 256 is interconnected to the two transistors 268, interconnected in a push-pull arrangement. The frequency at which the output from the two push-pull transistors 268 oscillate is dependant upon the values of the R-C circuit 266. For the present invention, the oscillation rate is approximately 5000 hertz. This output is applied to the autotransformer 84, where the amplitude of the voltage is significantly increased.

The flame sensing circuit 23 includes a charging capacitor 270, three diodes 272, 274, 276, three capacitors 278, 280, 282, a voltage divider network 284, a measurement line 286, and an operational amplifier 288. The charging capacitor 270 includes positive and negative sides 292, 290. The 5000 hertz high voltage signal from the autotransformer 84 is sent, via the coupling line 66, to the charging capacitor 270 and flame probe 21. If a flame exists, the probe 21 will drain several microamps from the positive side 292 of the charging capacitor 270. If such a decrease is then detected by the rest of the flame sensing circuit 23, it will send a positive flame signal to the microprocessor 132 via the lead 46.

The three diodes 272–276 are connected in parallel. They are thus redundant in order to further increase the reliability of the control system 8. If one or even two of the diodes 272–276 should fail, a third would still operate to ensure that the voltage along the measurement line 286 never falls below −9 volts.

The three capacitors 278–282, also in parallel, steady the oscillating voltage along the measurement line 286. The voltage along the measurement line 286 is then compared with the voltage from the voltage divider network 284. If the voltage along the measurement line 286 is less than the voltage of output of the divider network 284, the probe 21 is shunting current, and a flame exists.

Thus, the operational amplifier 288 then provides a positive flame signal to the microprocessor 132. If, however, the voltages for the measurement line 286 and voltage divider network 284 are substantially the same, no flame exists. The operational amplifier 288 accordingly provides a low, or "blank" signal to the microprocessor 132.

Random electrical "noise" may be generated near the flame sensor 19 because of the 60 hertz signal applied to the input line 54 and because of the rapid sparking of the ignition source 18. A reliable flame sensor should not give incorrect signals because of such electrical noise.

Importantly, the use of the high frequency flame sensor power source 22 to provide an input to the flame sensing circuit 23 increases the reliability of the flame sensor 19 in the present invention. In addition to making the flame sensor 19 substantially immune from beat frequency effects, the flame sensor power source 22 also allows the flame sensor 19 to detect continuous as well as pulsed flames.

FLAME SENSOR TEST SEQUENCE

As an internal check, the microprocessor 132 regularly issues a high voltage signal at the output lead 158 and line 44. This signal, called a Flame Sensor Disable, or FSD signal, is then applied to second input 260 of the operational amplifier 256 in the flame sensor power source 22. Consequently, the flame sensor power source 22 no longer provides an output along the coupling line 66. The flame sensing circuit 23 should then also be disabled from detecting a flame, even if one exists.

If the flame sensing circuit 23 continues to provide a flame signal, via the line 46, to the microprocessor 132, however, the flame sensor 19 must be malfunctioning. The microprocessor 132 then responsively issues a disable signal to the gas valve assembly 14.

GAS VALVE TEST SEQUENCE

As yet another internal check for malfunctions within the control system 8 itself, the microprocessor 132 provides a predetermined sequence of disable signals at the output leads 146, 148. If the gas valve assembly 14 is functioning properly, a predetermined signal will be transmitted from the bottom 208 of the relay 204, via the line 38, to the input lead 142 of the microprocessor 132. If such a predetermined signal is not received, the gas valve assembly 14 is malfunctioning. In particular, the first or second transistors 212, 214, or the transistor 230, or the operational amplifier 228 may be shorted. Also, these components may be disabled by the error detector 56 or the voltage protection circuit 78 or otherwise unresponsive to enable or disable signals. This will cause the microprocessor to *also* cause a shutdown of the control 8. The sequence of signals issued by the microprocessor 132 in order to perform this test are set out in FIG. 4.

The test, having 19 possible steps S2000–S2018, is performed five times each second. When the time for the check occurs, the microprocessor determines, at step S2000, whether the gas valve assembly 14 should now be in an open or closed state. If no gas has been requested and the gas valve assembly 14 should be closed, the microprocessor 132 moves to the step S2001.

At the step S2001, a low voltage signal is momentarily provided along the line 34 in order to turn the top comparator 200 on. In addition, a high voltage signal is momentarily provided at the line 36 in order to turn the bottom comparator 202 on. The voltage at the bottom 208 of the relay 204 and the line 38 should be low. If this is not the case, one of the transistors 212, 214, 230 or the operational amplifier 228 may be faulty. Thus, the microprocessor 132 then disables the gas valve assembly 14 at the step S2003.

If, however, the voltage along the line 38 is low, as it should be, the microprocessor 132 issues (at step S2004) a low signal along line 36 in order to turn the transistor 230 off, to the condition it originally was at before the check began. Notably, the move from the step S2000 to the step S2004 occurs within about two milliseconds, such that the relay 204 does not have time to react. Rather, the relay 204 stays in the off and closed condition.

At the step S2005, the microprocessor 132 determines whether the voltage at the line 38 is high, as it should be if the transistor 230 has turned off. If the voltage is not low, the transistor 230 has failed to turn off, and the microprocessor 132 disables the gas valve assembly 14 at the steep S2006.

Next, at step S2007, the microprocessor 132 issues a high voltage along the line 34 in order to turn the first and second transistors 212, 214 off. If this has occurred, no current is flowing through the relay 204, and the voltage at the bottom 208 of the relay 204 and along the line 38 should be low. If it is not, either the first or second transistors 212, 214 has failed to turn off, and the microprocessor 132 disables the gas valve assembly 14 at step S2009. Otherwise, the gas valve assembly 14 has passed the check, and the control system 8 waits another 1/5 second before performing the test again.

The test uses a different sequence of steps than those previously discussed if the microprocessor 132 determines, at the step S2000, that the gas valve assembly 14 is on. In such a case, the microprocessor 132 moves to the step S2010, where high and low signals are momentarily issued at, respectively, the lines 34, 36. If the control system 8 is functioning properly, both the top and bottom comparators 200, 202 are then turned off.

Next, at the step S2011, the microprocessor 132 checks whether the voltage at the bottom 208 of the relay 204 is low, as it should be if both of the comparators 200, 202 are off. If the voltage is not low, the gas valve assembly 14 is closed at the step S2012.

Next, at the step S2013, a low voltage is applied to the lead 34 in order to attempt to turn the first and second transistors 212, 214 on. If the voltage at the bottom 208 of the relay 204 does not then become high, the transistors 212, 214 have not turned on as they should have, and the microprocessor 132 closes the gas valve assembly 14 in the step S2015.

Finally, at the step S2016, the microprocessor 132 issues a high voltage signal along the line 36 in order to turn the transistor 230 on. If the control system 8 is operating properly, the microprocessor 132 senses that the voltage at the bottom of the relay is low, and the gas valve assembly 14 has passed the test. Otherwise, the microprocessor 132 disables the gas valve assembly 14.

MICROPROCESSOR FUNCTIONS

As an additional feature, the diagnostic leads 159 of the microprocessors 132 may transmit a four bit binary number as an status and error code. See FIG. 3. If the control 8 is running normally, the code indicates the current state of the control 8.

The code may also be an indication of which inputs have caused the controller to move to the lockout state S1010 (FIG. 2) or otherwise close the gas valve assembly 14. The diagnostic leads 159 may be interconnected, for example, to a digital display (not shown). Should the furnace 10 or control system 8 malfunction, a repairman may then observe the digital display to learn why the controller 24 has closed the gas valve assembly 14.

When the microprocessor 132 detects a malfunction, the microprocessor 132 goes to the "DEAD" state. This state cannot be left except by a power interrupt, and *not* a resetting of the thermostat 20.

In addition, the microprocessor 132 includes a "built in" test routine, which may be utilized during production of the control 8. The control may be interfaced at the factory with automatic test equipment (not shown). The test equipment then provides a predetermined sequence of input signals to the controller 24. The test equipment may then sense if the controller 24 fails to provide a corresponding sequence of predetermined output signals and provide an indication that the control 8 may be defective.

Although the foregoing description of the preferred embodiment will enable a person of ordinary skill in the art to make and use the same, the following detailed assembly language listing for the microprocessor 132 is included. The assembly language listing provides detailed information concerning the programming and operation of the overall control system 8. Additional detailed features of the control system 8 will become apparent to those skilled in the art from reviewing the program.

```
**              OPTIONS   **
TRYOPT  EQU     5         NUMBER OF TRIES OPTION
IGNOPT  EQU     8         IGNITION TIME OPTION (SECONDS)
PRGOPT  EQU     3         PURGE-TIME OPTION (10'S OF SECONDS)
SKPOPT  EQU     0         SKIP POST-PURGE (15=SKIP, 0=NO)
*
**  OTHER PROGRAM OPTIONS   **
FSETMN  EQU     10        NORMAL-STATE FLAME-SENSE TIMEOUT (1.0 SEC
FSETMT  EQU     1         TEST-STATE FLAME-SENSE TIMEOUT (.1 SEC)
*
**  FAILURE CODES   **
H6CERR  EQU     10        60 HZ FAILURE
GASERR  EQU     11        GAS-VALVE ACKNOWLEDGEMENT FAILURE
FLMERR  EQU     12        FLAME-SENSE ENABLE FAILURE
RAMERR  EQU     13        RAM FAILURE WHILE RUNNING
ROMERR  EQU     14        ROM FAILURE (ONLY MINIMAL TESTING)
PWUERR  EQU     15        RAM FAILURE AT POWER-UP
*
**  R-LINES   **
GASKLR  EQU     0         GAS KILL
GASENR  EQU     1         GAS ENABLE
PRGENR  EQU     2         PURGE-FAN ENABLE
CPUA1R  EQU     3         CPU-ALIVE SIGNAL 1
IGNENR  EQU     4         IGNITION ENABLE
FLMDSR  EQU     5         FLAME SENSE DISABLE
ERRC3R  EQU     6         ERROR-CODE 8-BIT
ERRC4R  EQU     7         ERROR-CODE 4-BIT
ERRC2R  EQU     8         ERROR-CODE 2-BIT
CPUA2R  EQU     9         CPU-ALIVE SIGNAL 2
ERRC1R  EQU     10        ERROR-CODE 1-BIT
*
**  RAM FILE-0 EQUATES   **
KINPUT  EQU     0         K-LINE INPUTS:
KSTATE  EQU     1         K-LINE EFFECTIVE STATES:
HTRDMB  EQU     0         . K1: HEATER-DEMAND
FLMSNB  EQU     1         . K2: FLAME SENSE
GASAKB  EQU     2         . K4: GAS VALVE ACK (KINPUT)
PWRLNB  EQU     3         . K8: POWER-LINE SENSE
ROUREQ  EQU     2         R-LINE OUTPUT REQUESTS:
PRGRQB  EQU     0         . PURGE-FAN
IGNRQB  EQU     1         . IGNITION
GASRQB  EQU     2         . GAS VALVE
STATE   EQU     3         STATE
```

```
                TRYCTR EQU    4       # OF TRIES COUNTER
                TIM60H EQU    5       60 HZ TIMER
                TIMP1S EQU    6       .1 SEC TIMER
                TIM1S  EQU    7       1 SEC TIMER
                TIM10S EQU    8       10 SEC TIMER
                PGMFLG EQU    9       PROGRAM FLAGS: (MUST BE AFTER TIM10S)
                FLMFGB EQU    0       . FLAME ESTABLISHED FLAG
                FSTSTB EQU    1       . FLAME-SENSE TEST FLAG
                TIMOUB EQU    2       . TIME-OUT FLAG
                TIM10Z EQU    9       TIMER LOOP TEST
                PLTDG0 EQU    10      PWR-LINE TIMEOUT DIGIT 0
                PLTDG1 EQU    11      PWR-LINE TIMEOUT DIGIT 1
                PLTDG2 EQU    12      PWR-LINE TIMEOUT DIGIT 2
                PLTDGZ EQU    13      PWR-LINE TIMEOUT LOOP TEST
                HTRDEB EQU    13      HEATER-DEMAND DEBOUNCE COUNTER
                FSEDEB EQU    14      FLAME-SENSE DEBOUNCE COUNTER
                *
                **  RAM FILE-1 EQUATES  **
                ERRCOD EQU    0       ERROR CODE
                ERRRSL EQU    1       R-LINE SELECT
                *
                ** EQUATES FOR X-REGISTER **
                FILE0A EQU    0
                FILE1A EQU    1
                FILE1B EQU    2
                FILE0B EQU    3
                *
0 0  0 1B              BL     PWRUP
0 0  0 80
                *
                ***  1. RESET 1 STATE  ***
                *
0 0  2 CE RESET1 CALL  RESET2 RESET OUTPUT REQUESTS
0 0  3 42              TCY    TRYCTR
0 0  4 6A              TCMIY  TRYOPT
0 0  5 3F              LDX    FILE0B
0 0  6 42              TCY    TRYCTR
0 0  7 6A              TCMIY  TRYOPT
0 0  8 3C              LDX    FILE0A
0 0  9 48 RS120        TCY    1       STATE 1
0 0 10 12              BL     HKEEP
0 0 10 91
0 0 12 54 HKR01        YNEC   2
0 0 13 90              BR     RS2DEA
0 0 14 48              TCY    KSTATE
0 0 15 3A              TBIT1  FLMSNB
0 0 16 BB              BR     RS120   WAIT TILL FLAME OUT
                *
                *
                ***  2. RESET 2 STATE  ***
                *
0 0 17 3F RESET2 LDX   FILE0B
0 0 18 44              TCY    ROUREQ
0 0 19 60              TCMIY  0       RESET OUTPUT REQUESTS
0 0 20 3C              LDX    FILE0A
0 0 21 44              TCY    ROUREQ
0 0 22 60              TCMIY  0
0 0 23 0F              RETN
0 0 24 3F              LDX    FILE0B
0 0 25 49              TCY    PGMFLG
0 0 26 34              RBIT   FLMFGB
```

```
0 0 27 3C          LDX     FILEOA
0 0 28 49          TCY     PGMFLG
0 0 29 34          RBIT    FLMFGB
0 0 30 44 RS220    TCY     2        STATE 2
0 0 31 12          BL      HKEEP
0 0 31 91
0 0 33 5C HKR02    YNEC    3
0 0 34 90          BR      RS2DEA
0 0 35 48          TCY     KSTATE
0 0 36 3A          TBIT1   FLMSNB CHECK FOR FLAME
0 0 37 A9          BR      RS2LKU FLAME NOT EXPECTED
0 0 38 38          TBIT1   HTRDMB CHECK FOR DEMAND
0 0 39 9A          BR      RS2STR
0 0 40 97          BR      RS220  STAY IN STATE 2
0 0 41 18 RS2STR   BL      STRPRG
0 0 41 83
            *
0 1  0 1B          BL      PWRUP
0 1  0 80
            *
            ***  3. START PURGE  ***
            *
0 1  2 44 STRPRG   TCY     ROUREQ TURN ON PURGE FAN
0 1  3 30          SBIT    PRGRQB
0 1  4 3F          LDX     FILEOB
0 1  5 44          TCY     ROUREQ
0 1  6 30          SBIT    PRGRQB
0 1  7 46          TCY     TIMP1S INIT PURGE TIMER
0 1  8 60          TCMIY   0      .1 SECS
0 1  9 60          TCMIY   0      1 SECS
0 1 10 6C          TCMIY   PRGOPT 10 SECS
0 1 11 31          SBIT    TIMOUB TIME-OUT FLAG
0 1 12 3C          LDX     FILEOA
0 1 13 46          TCY     TIMP1S
0 1 14 60          TCMIY   0
0 1 15 60          TCMIY   0
0 1 16 6C          TCMIY   PRGOPT
0 1 17 31          SBIT    TIMOUB
0 1 18 0F          RETN
            *
            *
            ***  4. PRE-PURGE  ***
            *
0 1 19 42 PREPRG   TCY     4        STATE 4
0 1 20 12          BL      HKEEP
0 1 20 91
0 1 22 5A HKR04    YNEC    5
0 1 23 90          BR      PREDEA
0 1 24 48          TCY     KSTATE
0 1 25 3A          TBIT1   FLMSNB CHECK FOR FLAME
0 1 26 86          BR      PRELKU FLAME NOT EXPECTED
0 1 27 38          TBIT1   HTRDMB CHECK FOR HEATER DEMAND
0 1 28 AE          BR      PRE20
0 1 29 10          BL      RESET1 DEMAND WENT AWAY
0 1 29 83
0 1 31 49 PRE20    TCY     PGMFLG WAIT OUT TIME
0 1 32 39          TBIT1   TIMOUB
0 1 33 BA          BR      PREPRG
0 1 34 14          BL      IGNITE
0 1 34 83
            *
```

```
0 1 36 12 PRELKU BL      LOCKUP
0 1 36 85
          *
0 1 38 13        BL      ROMDEA
0 1 38 90
0 1 40 13        BL      ROMDEA
0 1 40 90
0 1 42 13        BL      ROMDEA
0 1 42 90
0 1 44 13        BL      ROMDEA
0 1 44 90
0 1 46 13        BL      ROMDEA
0 1 46 90
0 1 48 13        BL      ROMDEA
0 1 48 90
0 0 43 12 RS2LKU BL      LOCKUP
0 0 43 85
0 0 45 13        BL      ROMDEA
0 0 45 90
0 0 47 13        BL      ROMDEA
0 0 47 90
0 0 49 13        BL      ROMDEA
0 0 49 90
0 0 51 13        BL      ROMDEA
0 0 51 90
0 0 53 13        BL      ROMDEA
0 0 53 90
0 0 55 13        BL      ROMDEA
0 0 55 90
0 0 57 13        BL      ROMDEA
0 0 57 90
0 0 59 13        BL      ROMDEA
0 0 59 90
0 0 61 47        TCY     ROMERR
0 0 62 13 RS2DEA BL      ROMDEA
0 0 62 90
0 1 50 13        BL      ROMDEA
0 1 50 90
0 1 52 13        BL      ROMDEA
0 1 52 90
0 1 54 13        BL      ROMDEA
0 1 54 90
0 1 56 13        BL      ROMDEA
0 1 56 90
0 1 58 13        BL      ROMDEA
0 1 58 90
0 1 60 13        BL      ROMDEA
0 1 60 90
0 1 62 13 PREDEA BL      ROMDEA
0 1 62 90
0 2  0 1B        BL      PWRUP
0 2  0 80
          *
          *** 5. IGNITION ***
          *
0 2  2 44 IGNITE TCY     ROUREQ
0 2  3 32        SBIT    IGNRQB
0 2  4 31        SBIT    GASRQB
0 2  5 3F        LDX     FILEOB
0 2  6 44        TCY     ROUREQ
```

```
0 2  7 32          SBIT   IGNRQB
0 2  8 31          SBIT   GASRQB
0 2  9 46          TCY    TIMP1S SET IGNITION TIMER
0 2 10 60          TCMIY  0      .1 SECS
0 2 11 61          TCMIY  IGNOPT 1 SECS
0 2 12 60          TCMIY  0      10 SECS
0 2 13 31          SBIT   TIMOUB TIME-OUT FLAG
0 2 14 3C          LDX    FILEOA
0 2 15 46          TCY    TIMP1S
0 2 16 60          TCMIY  0
0 2 17 61          TCMIY  IGNOPT
0 2 18 60          TCMIY  0
0 2 19 31          SBIT   TIMOUB
0 2 20 4A IGN10    TCY    5      STATE 5
0 2 21 12          BL     HKEEP
0 2 21 91
0 2 23 56 HKR05    YNEC   6
0 2 24 90          BR     IGNDEA
0 2 25 48          TCY    KSTATE
0 2 26 38          TBIT1  HTRDMB CK HEATER DEMAND
0 2 27 8B          BR     IGN30
0 2 28 9A          BR     IGN40  DEMAND WENT AWAY
0 2 29 49 IGN30    TCY    PGMFLG WAIT OUT TIME
0 2 30 39          TBIT1  TIMOUB
0 2 31 B8          BR     IGN32
0 2 32 98          BR     IGN38
0 2 33 00 IGN32    COMX
0 2 34 49          TCY    PGMFLG
0 2 35 39          TBIT1  TIMOUB
0 2 36 B5          BR     IGN10
0 2 37 90          BR     IGNDEA
0 2 38 48 IGN38    TCY    KSTATE
0 2 39 3A          TBIT1  FLMSNB DID FLAME LIGHT?
0 2 40 A9          BR     FLMEST FLAME DETECTED
0 2 41 1C IGN40    BL     INCTRY
0 2 41 B5
            *
            *
            *** 6A. FLAME ESTABLISHED  ***
            *
0 2 43 49 FLMEST   TCY    PGMFLG
0 2 44 30          SBIT   FLMFGB SET FLAME EST FLAG
0 2 45 00          COMX
0 2 46 49          TCY    PGMFLG
0 2 47 30          SBIT   FLMFGB
0 2 48 44          TCY    ROUREQ
0 2 49 36          RBIT   IGNRQB TURN OFF IGNITION
0 2 50 34          RBIT   PRGRQB TURN OFF PURGE FAN
0 2 51 00          COMX
0 2 52 44          TCY    ROUREQ
0 2 53 36          RBIT   IGNRQB
0 2 54 34          RBIT   PRGRQB
0 2 55 1C          BL     FME20
0 2 55 83
            *
0 2 57 13          BL     ROMDEA
0 2 57 90
0 2 59 13          BL     ROMDEA
0 2 59 90
0 2 61 47          TCY    ROMERR
```

```
0 2 62 13 IGNDEA BL      ROMDEA
0 2 62 90
          *
0 3  0 1B        BL      PWRUP
0 3  0 80
          *
0 3  2 46 FME20  TCY     6        STATE 6
0 3  3 12        BL      HKEEP
0 3  3 91
0 3  5 5E HKR06  YNEC    7
0 3  6 90        BR      FMEDEA
0 3  7 48        TCY     KSTATE
0 3  8 3A        TBIT1   FLMSNB CHECK FLAME
0 3  9 AF        BR      FME30
0 3 10 9C        BR      STRPPG FLAME WENT AWAY
0 3 11 00 FME30  COMX
0 3 12 48        TCY     KSTATE
0 3 13 3A        TBIT1   FLMSNB
0 3 14 A7        BR      FME40
0 3 15 90        BR      FMEDEA
0 3 16 48 FME40  TCY     KSTATE
0 3 17 38        TBIT1   HTRDMB CHECK HEATER DEMAND
0 3 18 83        BR      FME20
0 3 19 9C        BR      STRPPG DEMAND WENT AWAY
          *
          *
          *** 6B. NO FLAME, COUNT TRIES
0 3 20 3F INCTRY LDX     FILEOB
0 3 21 42        TCY     TRYCTR
0 3 22 2A        DMAN
0 3 23 B0        BR      INT20
0 3 24 0E        IA              DON'T DECR BELOW 0
0 3 25 03 INT20  TAM
0 3 26 3C        LDX     FILEOA
0 3 27 42        TCY     TRYCTR
0 3 28 2A        DMAN
0 3 29 AE        BR      INT30
0 3 30 0E        IA
0 3 31 03 INT30  TAM
          *
          *
          *** 7. START POST-PURGE ***
          *
0 3 32 3F STRPPG LDX     FILEOB
0 3 33 44        TCY     ROUREQ
0 3 34 36        RBIT    IGNRQB BE SURE IGNITION OFF
0 3 35 35        RBIT    GASRQB TURN OFF GAS
0 3 36 30        SBIT    PRGRQB TURN ON PURGE FAN
0 3 37 3C        LDX     FILEOA
0 3 38 44        TCY     ROUREQ
0 3 39 36        RBIT    IGNRQB
0 3 40 35        RBIT    GASRQB
0 3 41 30        SBIT    PRGRQB
          *  IF FLAME ESTABLISHED, CHECK FOR RETRY
0 3 42 49        TCY     PGMFLG
0 3 43 38        TBIT1   FLMFGB WAS FLAME EST?
0 3 44 8C        BR      SPP40  YES
0 3 45 48        TCY     KSTATE
0 3 46 38        TBIT1   HTRDMB IS THERE STILL HEATER DEMAND?
0 3 47 84        BR      SPP30  YES
0 3 48 8C        BR      SPP40  NO
0 3 49 42 SPP30  TCY     TRYCTR
```

```
0 3 50 18          LDP     STRPRG
0 3 51 26          MNEZ            # OF RETRIES EXCEEDED?
0 3 52 83          BR      STRPRG NO
0 3 53 40 SPP40    TCY     SKPOPT SKIP POST PURGE?
0 3 54 12          LDP     PPG40
0 3 55 2B          IYC
0 3 56 96          BR      PPG40  SKPOPT=15, YES
0 3 57 13          LDP     ROMDEA
0 3 58 58          YNEC    1
0 3 59 90          BR      ROMDEA
0 3 60 12          BL      PSTPRG
0 3 60 83
                 *
0 3 62 13 FMEDEA BL        ROMDEA
0 3 62 90
                 *
0 4  0 18          BL      PWRUP
0 4  0 80
                 *
                 ***  8. POST PURGE  ***
                 *
0 4  2 18 PSTPRG CALLL  STRPRG START POST PURGE
0 4  2 C3
0 4  4 41 PPG20  TCY     8       STATE 8
0 4  5 91        BR      HKEEP
0 4  6 59 HKR08  YNEC    9
0 4  7 90        BR      ROMDEA
0 4  8 48        TCY     KSTATE
0 4  9 38        TBIT1   HTRDMB
0 4 10 B3        BR      PPG30
                 *     NO HEATER DEMAND
0 4 11 49        TCY     PGMFLG IS PURGE TIMED OUT?
0 4 12 39        TBIT1   TIMOUB
0 4 13 8F        BR      PPG20  NO
0 4 14 96        BR      PPG40  YES
                 *     TEST # OF TRIES
0 4 15 42 PPG30  TCY     TRYCTR
0 4 16 26        MNEZ
0 4 17 96        BR      PPG40
                 *     END OF POST-PURGE WITH MAX TRIES
0 4 18 49        TCY     PGMFLG PURGE TIMED OUT?
0 4 19 39        TBIT1   TIMOUB
0 4 20 8F        BR      PPG20
0 4 21 85        BR      LOCKUP
                 *     END OF POST-PURGE
0 4 22 49 PPG40  TCY     PGMFLG
0 4 23 38        TBIT1   FLMFGB WAS FLAME ESTABLISHED?
0 4 24 A1        BR      PPG44
0 4 25 85        BR      LOCKUP
0 4 26 10 PPG44  BL      RESET1
0 4 26 83
                 *
                 *
                 ***  9. LOCKOUT  ***
                 *
0 4 28 10 LOCKUP CALLL  RESET2 KILL ALL REQUESTS
0 4 28 CE
0 4 30 49 LKU20  TCY     9       STATE=9
0 4 31 91        BR      HKEEP
0 4 32 55 HKR09  YNEC    10
```

```
0 4 33 90          BR      ROMDEA
0 4 34 48          TCY     KSTATE
0 4 35 3A          TBIT1   FLMSNB
0 4 36 97          BR      LKU20
0 4 37 38          TBIT1   HTRDMB
0 4 38 9A          BR      LKU30
0 4 39 10          BL      RESET1
0 4 39 83
0 4 41 42 LKU30    TCY     TRYCTR
0 4 42 26          MNEZ
0 4 43 A4          BR      LKU40
0 4 44 97          BR      LKU20   TRIES EXCEEDED
0 4 45 10 LKU40    BL      RESET2
0 4 45 8E
             *
             *
             ***  HOUSEKEEPING  ***
             *
             **  SAVE STATE  **
0 4 47 23 HKEEP    TYA
0 4 48 3C          LDX     FILE0A
0 4 49 4C          TCY     STATE
0 4 50 03          TAM
0 4 51 3F          LDX     FILE0B
0 4 52 4C          TCY     STATE
0 4 53 03          TAM
0 4 54 13          CALLL   SHOSTA
0 4 54 F0
             **  TICK TIMERS  **
             *  RUN TIMER ON ONE RAM FILE
0 4 56 4A HKLOOP   TCY     TIM60H
0 4 57 1A          LDP     TIK30
0 4 58 2A          DMAN
0 4 59 B7          BR      TIK30
0 4 60 1A          BL      TIK10
0 4 60 83
             *
0 4 62 13          BL      ROMDEA
0 4 62 F0
             *
0 5  0 1B          BL      PWRUP
0 5  0 80
             *
0 5  2 6A TIK10    TCMIY   5
             *    COUNT 10'THS, 1'S & 10'S OF SECONDS
0 5  3 2A TIK20    DMAN
0 5  4 B7          BR      TIK30
0 5  5 69          TCMIY   9
0 5  6 59          YNEC    TIM10Z
0 5  7 87          BR      TIK20
0 5  8 35          RBIT    TIMOUB SET TIMED-OUT FLAG
0 5  9 AF          BR      TIK32
             *    STORE LAST VALUE
0 5 10 03 TIK30    TAM
             *  RUN TIMER ON OTHER RAM FILE
0 5 11 00 TIK32    COMX
0 5 12 4A          TCY     TIM60H
0 5 13 2A          DMAN
0 5 14 AC          BR      TIK50
0 5 15 6A          TCMIY   5
```

```
                *     COUNT 10'THS, 1'S & 10'S OF SECONDS
0 5 16 2A TIK40   DMAN
0 5 17 AC         BR      TIK50
0 5 18 69         TCMIY   9
0 5 19 59         YNEC    TIM10Z
0 5 20 A7         BR      TIK40
0 5 21 35         RBIT    TIMOUB SET TIMED-OUT FLAG
0 5 22 98         BR      HDB00
                *     STORE LAST VALUE
0 5 23 03 TIK50   TAM
                *
                **  DEBOUNCE HEAT DEMAND LINE  **
0 5 24 48 HDB00   TCY     KSTATE
0 5 25 38         TBIT1   HTRDMB
0 5 26 AE         BR      HDB1X
0 5 27 40         TCY     KINPUT
0 5 28 38         TBIT1   HTRDMB
0 5 29 B4         BR      HDB01
0 5 30 84         BR      HDB11
0 5 31 40 HDB1X   TCY     KINPUT
0 5 32 38         TBIT1   HTRDMB
0 5 33 84         BR      HDB11
0 5 34 4B HDB10   TCY     HTRDEB DEBOUNCE IT
0 5 35 2A         DMAN
0 5 36 B2         BR      HDBNY  NOT YET
0 5 37 48         TCY     KSTATE CHANGE STATE
0 5 38 34         RBIT    HTRDMB
0 5 39 00         COMX
0 5 40 34         RBIT    HTRDMB
0 5 41 84         BR      HDB11
0 5 42 4B HDB01   TCY     HTRDEB DEBOUNCE IT
0 5 43 2A         DMAN
0 5 44 B2         BR      HDBNY  NOT YET
0 5 45 48         TCY     KSTATE CHANGE STATE
0 5 46 30         SBIT    HTRDMB
0 5 47 00         COMX
0 5 48 30         SBIT    HTRDMB
0 5 49 4B HDB11   TCY     HTRDEB SET DEBOUNCE COUNT TO MAX
0 5 50 6C         TCMIY   3
0 5 51 00         COMX
0 5 52 4B         TCY     HTRDEB
0 5 53 6C         TCMIY   3
0 5 54 95         BR      HDB90
0 5 55 03 HDBNY   TAM
0 5 56 00         COMX
0 5 57 03         TAM
0 5 58 3C HDB90   LDX     FILEOA
0 5 59 16         BL      PWLNEG
0 5 59 83
                *
0 5 61 47         TCY     ROMERR
0 5 62 13         BL      ROMDEA
0 5 62 90
                *
0 6  0 1B         BL      PWRUP
0 6  0 80
                *
                **  WAIT FOR NEGATIVE SIDE OF POWER CYCLE  **
0 6  2 15 PWLNEG CALLL    PLTINI
0 6  2 DE
```

```
0 6  4 15 PWL20  CALLL  PLTMCK CHECK FOR TIMEOUT
0 6  4 EC
0 6  6 50        YNEC   KINPUT
0 6  7 99        BR     PWLDEA
0 6  8 3B        TBIT1  PWRLNB
0 6  9 8F        BR     PWL20
0 6 10 4C        TCY    CPUA1R TOGGLE CPU ALIVE R-LINES
0 6 11 0C        RSTR
0 6 12 49        TCY    CPUA2R
0 6 13 0C        RSTR
                 *
                 *  SELECT DESIRED HOUSE-KEEPING DURING DEAD TIME
0 6 14 4C        TCY    STATE  IF POWER-UP STATE,
0 6 15 26        MNEZ
0 6 16 BA        BR     PWL30
0 6 17 1E        BL     RAMCK0 SKIP MOST HOUSEKEEPING
0 6 17 AD
0 6 19 4A PWL30  TCY    TIM60H
0 6 20 21        TMA
0 6 21 00        COMX
0 6 22 4A        TCY    TIM60H
0 6 23 22        TMY
0 6 24 02        YNEA
0 6 25 8A        BR     PWLRDE
0 6 26 11        LDP    GASCHK
0 6 27 70        ALEC   0
0 6 28 83        BR     GASCHK CHECK GAS VALVE & PURGE-FAN
0 6 29 1E        LDP    RAMCK0
0 6 30 74        ALEC   2
0 6 31 AD        BR     RAMCK0
0 6 32 72        ALEC   4
0 6 33 B4        BR     RAMCK1
0 6 34 19        LDP    FSECHK
0 6 35 7A        ALEC   5
0 6 36 83        BR     FSECHK FLAME-SENSE TEST
0 6 37 13        BL     ROMDEA
0 6 37 90
                 *
                 *  WAIT FOR POSITIVE SIDE OF POWER CYCLE
0 6 39 15 PWLPOS CALLL  PLTINI
0 6 39 DE
0 6 41 15 PWL50  CALLL  PLTMCK CHECK FOR TIMEOUT
0 6 41 EC
0 6 43 50        YNEC   KINPUT
0 6 44 99        BR     PWLDEA
0 6 45 3B        TBIT1  PWRLNB
0 6 46 A2        BR     PWL60
0 6 47 9A        BR     PWL50
0 6 48 4C PWL60  TCY    CPUA1R TOGGLE CPU ALIVE R-LINES
0 6 49 0D        SETR
0 6 50 49        TCY    CPUA2R
0 6 51 0D        SETR
0 6 52 1E        BL     IGFIRE
0 6 52 83
                 *
0 6 54 45 PWLDEA TCY    H60ERR
0 6 55 13        BL     DEAD
0 6 55 87
0 6 57 4B PWLRDE TCY    RAMERR
```

```
0 6 58 13          BL      DEAD
0 6 58 87
                *
0 6 60 13          BL      ROMDEA
0 6 60 90
0 6 62 13          BL      ROMDEA
0 6 62 90
                *
0 7  0 1B          BL      PWRUP
0 7  0 80
                *
                *  CHECK TO FIRE IGNITION (EVERY 60'TH SECOND)
0 7  2 44 IGFIRE TCY     ROUREQ
0 7  3 3A          TBIT1   IGNRQB
0 7  4 BF          BR      IGF15
0 7  5 B8          BR      IGF80  NOT REQUESTED
                *    DON'T FIRE IT LAST .1 SEC SO FLAME-SENSE WILL SETTLE
0 7  6 4E IGF15  TCY     TIM1S
0 7  7 26          MNEZ
0 7  8 9D          BR      IGF20
0 7  9 46          TCY     TIMP1S
0 7 10 26          MNEZ
0 7 11 9D          BR      IGF20
0 7 12 44          TCY     ROUREQ CANCEL IGNITION REQUEST
0 7 13 36          RBIT    IGNRQB
0 7 14 00          COMX
0 7 15 44          TCY     ROUREQ
0 7 16 36          RBIT    IGNRQB
0 7 17 B8          BR      IGF80
0 7 18 40 IGF20  TCY     KINPUT
0 7 19 08          TKA
0 7 20 03          TAM
0 7 21 00          COMX
0 7 22 03          TAM
0 7 23 3B          TBIT1   PWRLNB BE SURE POWER LINE STILL POSITIVE
0 7 24 A1          BR      IGF30
0 7 25 B8          BR      IGF80
0 7 26 42 IGF30  TCY     IGNENR
0 7 27 0D          SETR
0 7 28 49          TCY     9      LEAVE IT ON 200 USEC MINIMUM
0 7 29 2C IGF40  DYN
0 7 30 8B          BR      IGF40
0 7 31 42          TCY     IGNENR
0 7 32 0C          RSTR
                *  STAY IN HOUSE-KEEPING 5 OUT OF 6 POWER-LINE CYCLES
0 7 33 3C IGF80  LDX     FILE0A
0 7 34 4A          TCY     TIM60H
0 7 35 12          LDP     HKLOOP
0 7 36 26          MNEZ
0 7 37 A5          BR      HKLOOP
0 7 38 1D          BL      HKEXIT
0 7 38 B1
                *
                ***  RAM CHECK  ***
0 7 40 3C RAMCK0 LDX     FILE0A FILES 0 & 3
0 7 41 A9          BR      RAM20
0 7 42 3E RAMCK1 LDX     FILE1A FILES 1 & 2
0 7 43 4F RAM20  TCY     15
0 7 44 21 RAM30  TMA
0 7 45 00          COMX
```

```
0 7 46 27          SAMAN
0 7 47 2D          CPAIZ
0 7 48 A6          BR      RAM40
0 7 49 4B          TCY     RAMERR
0 7 50 13          BL      DEAD
0 7 50 87
0 7 52 2C RAM40    DYN
0 7 53 92          BR      RAM30
0 7 54 3E          LDX     FILE1A
0 7 55 16          BL      PWLPOS
0 7 55 B6
          *
0 7 57 13          BL      ROMDEA
0 7 57 90
0 7 59 13          BL      ROMDEA
0 7 59 90
0 7 61 47          TCY     ROMERR
0 7 62 13          BL      ROMDEA
0 7 62 90
          *
0 8  0 1B          BL      PWRUP
0 8  0 80
          *
          *  SET GAS-VALVE R-LINE & CHECK FOR HARDWARE FAILURE
0 8  2 44 GASCHK   TCY     ROUREQ
0 8  3 39          TBIT1   GASRQB
0 8  4 98          BR      GRL50
          *    GAS VALVE CLOSED (GAS OFF)
0 8  5 48          TCY     GASENR
0 8  6 0D          SETR            BOTTOM TRANSISTOR ON
0 8  7 40          TCY     GASKLR
0 8  8 0C          RSTR            TOP TRANSISTOR ON
0 8  9 C8          CALL    GRLTKA
0 8 10 39          TBIT1   GASAKB
0 8 11 86          BR      GRLBLD
0 8 12 48          TCY     GASENR
0 8 13 0C          RSTR            BOTTOM TRANSISTOR OFF
0 8 14 C8          CALL    GRLTKA
0 8 15 39          TBIT1   GASAKB
0 8 16 9D          BR      GRL30
0 8 17 86          BR      GRLBLD
0 8 18 40 GRL30    TCY     GASKLR
0 8 19 0D          SETR            TOP TRANSISTOR OFF
0 8 20 C8          CALL    GRLTKA
0 8 21 39          TBIT1   GASAKB
0 8 22 86          BR      GRLBLD
0 8 23 92          BR      GRL80
          *    GAS VALVE OPEN (GAS ON)
0 8 24 40 GRL50    TCY     GASKLR
0 8 25 0D          SETR            TOP TRANSISTOR OFF
0 8 26 48          TCY     GASENR
0 8 27 0C          RSTR            BOTTOM TRANSISTOR OFF
0 8 28 C8          CALL    GRLTKA
0 8 29 39          TBIT1   GASAKB
0 8 30 86          BR      GRLBLD
0 8 31 40          TCY     GASKLR
0 8 32 0C          RSTR            TOP TRANSISTOR ON
0 8 33 C8          CALL    GRLTKA
0 8 34 39          TBIT1   GASAKB
0 8 35 B6          BR      GRL60
```

```
0 8 36 4D GRLBLD TCY     GASERR
0 8 37 13        BL      DEAD
0 8 37 87
0 8 39 48 GRL60  TCY     GASENR
0 8 40 0D        SETR            BOTTOM TRANSISTOR ON
0 8 41 C8        CALL    GRLTKA
0 8 42 39        TBIT1   GASAKB
0 8 43 86        BR      GRLBLD
0 8 44 15 GRL80  BL      PRGCHK
0 8 44 83
          *
          *     READ K-LINES FOR GAS-CONTROL CHECK
0 8 46 47 GRLTKA TCY     14      DELAY 1 MILLISECOND
0 8 47 2F GKA20  CLA
0 8 48 2F        CLA
0 8 49 2C        DYN
0 8 50 91        BR      GKA20
0 8 51 40        TCY     KINPUT
0 8 52 3F        LDX     FILEOB
0 8 53 08        TKA
0 8 54 03        TAM
0 8 55 3C        LDX     FILEOA
0 8 56 03        TAM
0 8 57 0F        RETN
          *
0 8 58 13        BL      ROMDEA
0 8 58 90
0 8 60 13        BL      ROMDEA
0 8 60 90
0 8 62 13        BL      ROMDEA
0 8 62 90
          *
0 9  0 1B        BL      PWRUP
0 9  0 80
          *
          **  FLAME-SENSE PROCESSING  **
          *
          *  CHECK FOR IGNITION IN PROGRESS
0 9  2 44 FSECHK TCY     ROUREQ
0 9  3 3A        TBIT1   IGNRQB
0 9  4 BA        BR      FSE40   IGNITION REQUESTED
          *  CHECK FOR FLAME-SENSE TEST MODE
0 9  5 49        TCY     PGMFLG
0 9  6 3A        TBIT1   FSTSTB
0 9  7 91        BR      FSE90
          *  CHECK FOR FLAME SENSED
0 9  8 40        TCY     KINPUT
0 9  9 3A        TBIT1   FLMSNB
0 9 10 8B        BR      FSE50
          *  NO FLAME DETECTED
0 9 11 47        TCY     FSEDEB  DEBOUNCE FLAME SENSE
0 9 12 2A        DMAN
0 9 13 B0        BR      FSE45
0 9 14 48        TCY     KSTATE  DEBOUNCED, IT'S OFF FOR SURE
0 9 15 36        RBIT    FLMSNB
0 9 16 00        COMX
0 9 17 48        TCY     KSTATE
0 9 18 36        RBIT    FLMSNB
          *  ZERO DEBOUNCE, RESET TEST MODE & ENABLE
0 9 19 47 FSE40  TCY     FSEDEB
```

```
0 9 20 60          TCMIY  0
0 9 21 00          COMX
0 9 22 47          TCY    FSEDEB
0 9 23 60          TCMIY  0
0 9 24 89          BR     FSE95
              *  NO FLAME SENSED, BUT NOT DEBOUNCED YET
0 9 25 03 FSE45    TAM
0 9 26 00          COMX
0 9 27 03          TAM
0 9 28 AD          BR     FSE70  PRETEND FLAME STILL ON
              *  FLAME DETECTED
0 9 29 4A FSE50    TCY    FLMDSR DISABLE FLAME SENSE
0 9 30 0D          SETR
0 9 31 49          TCY    PGMFLG SET TEST FLAG
0 9 32 32          SBIT   FSTSTB
0 9 33 47          TCY    FSEDEB SET DEBOUNCE COUNTER
0 9 34 6C          TCMIY  3      .4 SECONDS
0 9 35 00          COMX
0 9 36 49          TCY    PGMFLG
0 9 37 32          SBIT   FSTSTB
0 9 38 47          TCY    FSEDEB
0 9 39 6C          TCMIY  3
0 9 40 48 FSE70    TCY    KSTATE
0 9 41 32          SBIT   FLMSNB
0 9 42 00          COMX
0 9 43 32          SBIT   FLMSNB
0 9 44 3C FSE80    LDX    FILE0A
0 9 45 16          BL     PWLPOS
0 9 45 B6
              *
              *  IN FLAME-SENSE TEST MODE
0 9 47 40 FSE90    TCY    KINPUT
0 9 48 3A          TBIT1  FLMSNB
0 9 49 95          BR     FSEDEA
              *  RESET TEST MODE & ENABLE
0 9 50 4A FSE95    TCY    FLMDSR ENABLE FLAME SENSE
0 9 51 0C          RSTR
0 9 52 49          TCY    PGMFLG
0 9 53 36          RBIT   FSTSTB
0 9 54 00          COMX
0 9 55 49          TCY    PGMFLG
0 9 56 36          RBIT   FSTSTB
0 9 57 92          BR     FSE80
              *
0 9 58 43 FSEDEA   TCY    FLMERR
0 9 59 13          BL     DEAD
0 9 59 87
              *
0 9 61 47          TCY    ROMERR
0 9 62 13          BL     ROMDEA
0 9 62 90
              *
0 A  0 1B          BL     PWRUP
0 A  0 80
              *
              *  SET PURGE-FAN R-LINE
0 A  2 44 PRGCHK   TCY    ROUREQ
0 A  3 38          TBIT1  PRGRQB
0 A  4 BD          BR     PCK20
0 A  5 44          TCY    PRGENR PURGE FAN OFF
```

```
0 A  6 0C          RSTR
0 A  7 B7          BR      PCK80
0 A  8 44 PCK20    TCY     PRGENR PURGE FAN ON
0 A  9 0D          SETR
0 A 10 16 PCK80    BL      PWLPOS
0 A 10 B6
           *
           *** CHECK FOR POWER-LINE TIMEOUT
           *  INITIALIZE TIMEOUT CHECK
0 A 12 3F PLTINI   LDX     FILEOB
0 A 13 45          TCY     PLTDGO
0 A 14 6F          TCMIY   15      LOOP 1500 TIMES (.5 SEC)
0 A 15 6F          TCMIY   15      BEFORE DYING
0 A 16 66          TCMIY   6
0 A 17 3C          LDX     FILEOA
0 A 18 45          TCY     PLTDGO
0 A 19 6F          TCMIY   15
0 A 20 6F          TCMIY   15
0 A 21 66          TCMIY   6
0 A 22 0F          RETN
           *
           *  ONE POWER-LINE-TIMEOUT LOOP
0 A 23 45 PLTMCK   TCY     PLTDGO
0 A 24 2A PLT20    DMAN
0 A 25 B8          BR      PLT80
0 A 26 03          TAM
0 A 27 3F          LDX     FILEOB
0 A 28 6F          TCMIY   15
0 A 29 3C          LDX     FILEOA
0 A 30 5B          YNEC    PLTDGZ
0 A 31 98          BR      PLT20
0 A 32 0F          RETN            Y=PLTDGZ:  TIMED OUT
0 A 33 03 PLT80    TAM
0 A 34 3F          LDX     FILEOB
0 A 35 2A          DMAN
0 A 36 03          TAM
0 A 37 40          TCY     KINPUT
0 A 38 08          TKA
0 A 39 03          TAM
0 A 40 3C          LDX     FILEOA
0 A 41 03          TAM
0 A 42 0F          RETN
           *
0 A 43 13          BL      ROMDEA
0 A 43 90
0 A 45 13          BL      ROMDEA
0 A 45 90
0 A 47 13          BL      ROMDEA
0 A 47 90
0 A 49 13          BL      ROMDEA
0 A 49 90
0 A 51 13          BL      ROMDEA
0 A 51 90
0 A 53 13          BL      ROMDEA
0 A 53 90
0 A 55 13          BL      ROMDEA
0 A 55 90
0 A 57 13          BL      ROMDEA
0 A 57 90
0 A 59 13          BL      ROMDEA
```

```
 0 A 59 90
 0 A 61 47          TCY     ROMERR
 0 A 62 13          BL      ROMDEA
 0 A 62 90
                  *
 0 B  0 1B          BL      PWRUP
 0 B  0 80
                  *
                  ** POWER-UP CHECK FOR TEST CODE-SEQUENCE **
*0 B  2 DD CDECHK CALL     CDEGET
 0 B  3 58          YNEC    1
 0 B  4 A7          BR      CDENOT
 0 B  5 DD          CALL    CDEGET
 0 B  6 5C          YNEC    3
 0 B  7 A7          BR      CDENOT
 0 B  8 DD          CALL    CDEGET
 0 B  9 5A          YNEC    5
 0 B 10 A7          BR      CDENOT
 0 B 11 DD          CALL    CDEGET
 0 B 12 5E          YNEC    7
 0 B 13 A7          BR      CDENOT
 0 B 14 17          BL      PEXLIN
 0 B 14 83
 0 B 16 1F CDENOT BL        INITAL
 0 B 16 83
                  *
                  * TEST-CODE INPUT ROUTINE *
 0 B 18 45 CDEGET TCY     ERRC1R
 0 B 19 0D          SETR            TELL TESTER LOOKING FOR INPUT
 0 B 20 4F          TCY     15
 0 B 21 2C CDEG20 DYN               WAIT 500US
 0 B 22 AB          BR      CDEG20
 0 B 23 08          TKA             GET INPUT
 0 B 24 40          TCY     KINPUT
 0 B 25 03          TAM             SAVE INPUT
 0 B 26 45          TCY     ERRC1R
 0 B 27 0C          RSTR            TELL TESTER INPUT GOTTEN
 0 B 28 4F          TCY     15
 0 B 29 2C CDEG30 DYN               WAIT 500US
 0 B 30 8B          BR      CDEG30
 0 B 31 40          TCY     KINPUT
 0 B 32 22          TMY
 0 B 33 0F          RETN
                  *
                  *  HOUSEKEEPING EXIT ROUTINE
 0 B 34 4C HKEXIT TCY     STATE
 0 B 35 28          IMAC
 0 B 36 24          TAY
 0 B 37 1F          LDP     HKR00
 0 B 38 78          ALEC    1
 0 B 39 B1          BR      HKR00
 0 B 40 10          LDP     HKR01
 0 B 41 74          ALEC    2
 0 B 42 9E          BR      HKR01
 0 B 43 10          LDP     HKR02
 0 B 44 7C          ALEC    3
 0 B 45 B8          BR      HKR02
 0 B 46 18          LDP     HKR04
 0 B 47 7A          ALEC    5
 0 B 48 96          BR      HKR04
```

```
 0 B 49 14          LDP     HKR05
 0 B 50 76          ALEC    6
 0 B 51 AC          BR      HKR05
 0 B 52 1C          LDP     HKR06
 0 B 53 7E          ALEC    7
 0 B 54 9F          BR      HKR06
 0 B 55 12          LDP     HKR08
 0 B 56 79          ALEC    9
 0 B 57 BF          BR      HKR08
 0 B 58 12          LDP     HKR09
 0 B 59 75          ALEC    10
 0 B 60 9C          BR      HKR09
 0 B 61 47          TCY     ROMERR
 0 B 62 13          BL      ROMDEA
 0 B 62 90
                *
                    PAGE    0  C
 0 C  0 1B          BL      PWRUP
 0 C  0 80
                *
                ***  HARDWARE FAILURE HANG   ***
 0 C  2 47 ROMDE2 TCY       ROMERR
*0 C  3 13 DEAD    LDP     DEAD
 0 C  4 3E          LDX     FILE1A
 0 C  5 23          TYA             STORE ERROR CODE
 0 C  6 40          TCY     ERRCOD
 0 C  7 03          TAM
 0 C  8 E1          CALL    SHS10
                **  DEAD LOOP  **
 0 C  9 42 DEA60    TCY     IGNENR
 0 C 10 0C          RSTR
 0 C 11 40          TCY     GASKLR
 0 C 12 0D          SETR
 0 C 13 48          TCY     GASENR
 0 C 14 0C          RSTR
 0 C 15 44          TCY     PRGENR
 0 C 16 0C          RSTR
 0 C 17 4C          TCY     CPUA1R
 0 C 18 0C          RSTR
 0 C 19 49          TCY     CPUA2R
 0 C 20 0C          RSTR
 0 C 21 4A          TCY     FLMDSR
 0 C 22 0C          RSTR
 0 C 23 13          BL      DEA60
 0 C 23 BB
                *
                ** SHOW STATE **
 0 C 25 4C SHOSTA   TCY     STATE
 0 C 26 23 SHS10    TYA
 0 C 27 38          TBIT1   0
 0 C 28 9C          BR      SHS15
 0 C 29 45          TCY     ERRC1R
 0 C 30 0C          RSTR
 0 C 31 B1          BR      SHS20
 0 C 32 45 SHS15    TCY     ERRC1R
 0 C 33 0D          SETR
 0 C 34 24 SHS20    TAY
 0 C 35 3A          TBIT1   1
 0 C 36 AD          BR      SHS25
 0 C 37 41          TCY     ERRC2R
```

```
0 C 38 0C          RSTR
0 C 39 B4          BR      SHS30
0 C 40 41 SHS25    TCY     ERRC2R
0 C 41 0D          SETR
0 C 42 24 SHS30    TAY
0 C 43 39          TBIT1   2
0 C 44 A2          BR      SHS35
0 C 45 4E          TCY     ERRC4R
0 C 46 0C          RSTR
0 C 47 89          BR      SHS40
0 C 48 4E SHS35    TCY     ERRC4R
0 C 49 0D          SETR
0 C 50 24 SHS40    TAY
0 C 51 3B          TBIT1   3
0 C 52 A5          BR      SHS45
0 C 53 46          TCY     ERRC3R
0 C 54 0C          RSTR
0 C 55 0F          RETN
0 C 56 46 SHS45    TCY     ERRC3R
0 C 57 0D          SETR
0 C 58 0F          RETN
                *
0 C 59 13          BL      ROMDEA
0 C 59 90
0 C 61 47          TCY     ROMERR
0 C 62 13 ROMDEA   BL      ROMDE2
0 C 62 83
                *

                   PAGE    0 D
               ** POWER-UP RAM TEST **
                *
                *  INITIALIZE R-LINES
0 D  0 40 PWRUP    TCY     GASKLR
0 D  1 0D          SETR
                *  SETUP RAM FOR TEST
0 D  2 2F          CLA
0 D  3 3C PWU10    LDX     0
0 D  4 EE          CALL    PWUSET RAM FILES 0 & 3
0 D  5 3E          LDX     1
0 D  6 EE          CALL    PWUSET RAM FILES 1 & 2
                *  TEST RAM JUST SETUP
0 D  7 3C          LDX     0
0 D  8 ED          CALL    PWUCHK
0 D  9 07          DAN
0 D 10 99          BR      PWUDEA
0 D 11 3D          LDX     2
0 D 12 ED          CALL    PWUCHK
0 D 13 07          DAN
0 D 14 99          BR      PWUDEA
                *  RE-DO TEST WITH ALL BITS COMPLEMENTED
0 D 15 2F          CLA
0 D 16 07          DAN
0 D 17 3C          LDX     0
0 D 18 EE          CALL    PWUSET RAM FILES 0 & 3
0 D 19 3E          LDX     1
0 D 20 EE          CALL    PWUSET RAM FILES 1 & 2
                *  TEST RAM JUST SETUP
0 D 21 3F          LDX     3
0 D 22 ED          CALL    PWUCHK
```

```
0 D 23 07          DAN
0 D 24 99          BR      PWUDEA
0 D 25 3E          LDX     1
0 D 26 ED          CALL    PWUCHK
0 D 27 07          DAN
0 D 28 99          BR      PWUDEA
0 D 29 1D          BL      CDECHK
0 D 29 83
                *
0 D 31 24 PWUSET TAY                RAM FILES 1 & 2
0 D 32 6A PWUS20 TCMIY   5
0 D 33 2C          DYN
0 D 34 00          COMX
0 D 35 65          TCMIY   10       COMPLEMENTS OF ABOVE
0 D 36 02          YNEA
0 D 37 9C          BR      PWUS20
0 D 38 0E          IA
0 D 39 0F          RETN
                *
0 D 40 4F PWUCHK TCY     15
0 D 41 21 PWUC20 TMA                TEST FOR 10
0 D 42 06          A6AAC
0 D 43 07          DAN
0 D 44 A6          BR      PWUC80
0 D 45 00          COMX
0 D 46 28          IMAC             TEST FOR 5
0 D 47 05          A10AAC
0 D 48 07          DAN
0 D 49 A6          BR      PWUC80
0 D 50 2C          DYN
0 D 51 9A          BR      PWUC20
0 D 52 0E PWUC30 IA
0 D 53 0F          RETN
                *
                *  POWER-UP RAM TEST FAILS
0 D 54 4F PWUDEA TCY     PWUERR
0 D 55 13          BL      DEAD
0 D 55 87
                *
0 D 57 13          BL      ROMDEA
0 D 57 90
0 D 59 13          BL      ROMDEA
0 D 59 90
                   PAGE    0  E
0 E  0 1B          BL      PWRUP
0 E  0 80
                *
                **  POWER-UP EXERCISE OF K- & R-LINES (FOR PRODUCTION TESTING)
                *
0 E  2 45 PEXLIN TCY     PLTDGO
0 E  3 60          TCMIY   0        APPROX .5 SEC @ 17US/INSTR (1000 INSTR/.1
0 E  4 60          TCMIY   0
0 E  5 64          TCMIY   2
0 E  6 40          TCY     KINPUT
0 E  7 65          TCMIY   10       TURN ON R-LINE 10
0 E  8 21          TMA
0 E  9 03 PEX15  TAM
0 E 10 40 PEX20  TCY     KINPUT
0 E 11 22          TMY
```

```
0 E 12 08          TKA
0 E 13 02          YNEA
0 E 14 AC          BR      PEX40
0 E 15 45          TCY     PLTDGO
0 E 16 2A PEX30    DMAN
0 E 17 BB          BR      PEX15
0 E 18 20          TAMIY
0 E 19 5B          YNEC    PLTDGZ
0 E 20 A7          BR      PEX30
0 E 21 1F          BL      INITAL
0 E 21 83
            *  K-LINES CHANGED
0 E 23 40 PEX40    TCY     KINPUT
0 E 24 03          TAM             STORE NEW K-LINE VALUE
0 E 25 45          TCY     10
0 E 26 50 PEX42    YNEC    GASKLR
0 E 27 97          BR      PEX44
0 E 28 0D          SETR            SET GAS-KILL LINE
0 E 29 AE          BR      PEX46
0 E 30 0C PEX44    RSTR            RESET ALL OTHER R-LINES
0 E 31 2C PEX46    DYN
0 E 32 A1          BR      PEX42
            *    SELECT VALUE TO BE SET ON R-LINES
0 E 33 75          ALEC    10
0 E 34 B2          BR      PEX70   SET ONLY SELECTED R-LINE
0 E 35 7D          ALEC    11
0 E 36 B7          BR      PEX20   NO LINES ON
0 E 37 4A          TCY     TRYOPT
0 E 38 73          ALEC    12
0 E 39 91          BR      PEX50   SHOW # OF TRIES OPTION
0 E 40 41          TCY     IGNOPT
0 E 41 7B          ALEC    13
0 E 42 91          BR      PEX50   SHOW IGNITION TIME OPTION
0 E 43 4C          TCY     PRGOPT
0 E 44 77          ALEC    14
0 E 45 91          BR      PEX50   SHOW PURGE-TIME OPTION
0 E 46 40          TCY     SKPOPT  SHOW SKIP POST-PURGE OPTION
0 E 47 23 PEX50    TYA
0 E 48 4C          TCY     STATE
0 E 49 03          TAM
0 E 50 13          CALLL   SHOSTA
0 E 50 F0
0 E 52 49          TCY     CPUA2R
0 E 53 0D          SETR            SHOW VALUE STABLE
0 E 54 B7          BR      PEX20
            *    SET R-LINE INDICATED BY K-LINE BINARY VALUE
0 E 55 24 PEX70    TAY
0 E 56 50          YNEC    GASKLR
0 E 57 94          BR      PEX72
0 E 58 0C          RSTR            GAS-KILL LINE INVERTED
0 E 59 B7          BR      PEX20
0 E 60 0D PEX72    SETR
0 E 61 B7          BR      PEX20
            *
0 E 62 13          BL      ROMDEA
0 E 62 90
            *
                   PAGE    0  F
0 F  0 1B          BL      PWRUP
0 F  0 80
            *
```

```
                *
                ***  PROGRAM INITIALIZATION  ***
                *
                *  CLEAR RAM & R-LINES
*0 F  2 40 INITAL TCY     0
 0 F  3 2F        CLA
 0 F  4 50 INI50  YNEC    GASKLR
 0 F  5 BD        BR      INI52
 0 F  6 0D        SETR
 0 F  7 BB        BR      INI54
 0 F  8 0C INI52  RSTR
 0 F  9 3F INI54  LDX     3
 0 F 10 03        TAM
 0 F 11 3D        LDX     2
 0 F 12 03        TAM
 0 F 13 3E        LDX     1
 0 F 14 03        TAM
 0 F 15 3C        LDX     0
 0 F 16 20        TAMIY
 0 F 17 50        YNEC    0
 0 F 18 8F        BR      INI50
                *  STARTUP DELAY (RESET STATE 0)
 0 F 19 46        TCY     TIMP1S
 0 F 20 60        TCMIY   0
 0 F 21 64        TCMIY   2       WAIT 2 SECOND
 0 F 22 60        TCMIY   0
 0 F 23 31        SBIT    TIMOUB
 0 F 24 3F        LDX     FILE0B
 0 F 25 46        TCY     TIMP1S
 0 F 26 60        TCMIY   0
 0 F 27 64        TCMIY   2
 0 F 28 60        TCMIY   0
 0 F 29 31        SBIT    TIMOUB
 0 F 30 3C        LDX     FILE0A
 0 F 31 40 INI40  TCY     0
 0 F 32 12        BL      HKEEP
 0 F 32 91
 0 F 34 58 HKR00  YNEC    1
 0 F 35 90        BR      RSODEA
 0 F 36 49        TCY     PGMFLG
 0 F 37 39        TBIT1   TIMOUB
 0 F 38 AE        BR      INI40
                *  RUN PROGRAM
 0 F 39 10        BL      RESET1 RUN PROGRAM
 0 F 39 83
                *
 0 F 41 13        BL      ROMDEA
 0 F 41 90
 0 F 43 13        BL      ROMDEA
 0 F 43 90
 0 F 45 13        BL      ROMDEA
 0 F 45 90
 0 F 47 13        BL      ROMDEA
 0 F 47 90
 0 F 49 13        BL      ROMDEA
 0 F 49 90
 0 F 51 13        BL      ROMDEA
 0 F 51 90
 0 F 53 13        BL      ROMDEA
 0 F 53 90
```

```
0 F 55 13          BL      ROMDEA
0 F 55 90
0 F 57 13          BL      ROMDEA
0 F 57 90
0 F 59 13          BL      ROMDEA
0 F 59 90
0 F 61 47          TCY     ROMERR
0 F 62 13 RSODEA BL        ROMDEA
0 F 62 90
```

*

*

A preferred embodiment of the present invention has been described herein. It is to be understood, however, that changes and modifications can be made without departing from the true scope and spirit of the present invention. This true scope and spirit are defined by the following claims and their equivalents, to be interpreted in light of the foregoing specification.

What is claimed is:

1. An ignition control system for an appliance operating with a source of gas in response to a demand signal, said appliance including a combustion chamber for receiving said gas and containing a flame, comprising, in combination:

a valve for receiving an interconnect signal and responsively interconnecting said appliance with said source of gas and for receiving a lockout signal for responsively disconnecting said appliance from said source of gas;

an ignition source for receiving a ignition signal and responsively producing a ignite within said combustion chamber to ignite said gas;

a flame sensor for detecting said flame within said combustion chamber, said flame sensor responsively providing a flame signal upon detecting said flame and a blank signal before and after detecting said flame;

a blower for receiving a purge signal and responsively blowing gas out of said combustion chamber;

control means, interconnected to said valve, flame sensor, and blower, for receiving said demand signal and responsively issuing a purge signal to said blower for a first predetermined period and thereafter issuing said interconnect signal to said valve for a second predetermined period after said first predetermined period and for issuing said ignition signal to said spark generator during said second predetermined period, said control means also including a pulse generator emitting a counting pulse upon said control means receiving a blank signal from said flame sensor after said second predetermined period and a counter for receiving said counting pulse and, after said counter has received a predetermined number of count pulses, issuing a lockout signal to said valve.

2. An ignition control system as claimed in claim 1 further comprising thermostat means, interconnected to said control means, for sensing a predetermined condition and responsively issuing said demand signal.

3. An ignition control system as claimed in claim 2 wherein said control means is unresponsive to said blank signal from said flame sensor during said first and second predetermined periods.

4. An ignition control system as claimed in claim 3 wherein said control means receives said flame signal and issues a lockout signal to said valve upon receiving said flame signal during said first predetermined period.

5. An ignition control system as claimed in claim 4 wherein said control means further includes a test output, interconnected to said valve, for issuing output signals to said valve during an interval, and a test input, for receiving a test input signal from said valve during said interval, said control means further including a comparator for comparing said test input signal to a predetermined standard and issuing a disable signal to said valve if said test input signal fails to correspond to said predetermined standard.

6. An ignition control system as claimed in claim 5 wherein said appliance comprises a gas furnace and said predetermined condition sensed by said thermostat means is ambient temperature.

7. An ignition control system as claimed in claim 6 wherein said gas furnace comprises a pulse combustion furnace.

8. An ignition control system as claimed in claim 6 wherein said control means is interconnected to a power line having a voltage thereon and said control means further includes an error detector for comparing said voltage with a predetermined standard and responsively issuing a disable signal to said valve if said voltage exceeds said predetermined standard.

9. An ignition control system as claimed in claim 8 wherein said voltage on said power line alternates at a substantially predetermined first frequency and said control means includes a frequency check output for issuing a voltage which alternates at a second frequency and said control meansfurther includes comparator means for comparing said first and second frequencies and issuing a disable signal to said valve if said second frequency fails to correspond to said first frequency.

10. An ignition control system as claimed in claim 9 wherein said control means disables said flame sensor for a fixed interval and said controller further issues a disable signal to said valve upon receiving said flame signal during said fixed interval.

11. An ignition control system as claimed in claim 10 wherein said control means includes an internal check providing a signal at a substantially predetermined third frequency and a second comparator for comparing said first and third frequencies and issuing a disable signal to said valve if said first frequency fails to correspond to said third frequency.

12. An ignition control system as claimed in claim 11 wherein said control means senses a decrease in said demand signal and responsively discontinues said lockout signal.

13. An ignition control system as claimed in claim 12 wherein said disable signal is substantially unaffected by change in said demand signal.

14. An ignition control system as claimed in claim 13 wherein said control means senses a decrease in said voltage on said power line and responsively discontinues said lockout and disable signals.

* * * * *